US008888315B2

(12) United States Patent
Edwards et al.

(10) Patent No.: US 8,888,315 B2
(45) **Date of Patent: *Nov. 18, 2014**

(54) VAPOR-TIGHT LIGHTING FIXTURE

(75) Inventors: Richard D. Edwards, Westerly, RI (US); Stanley A. Katz, Saunderstown, RI (US)

(73) Assignee: Greendot Technologies, LLC, Mansfield, MA (US)

( * ) Notice: Subject to any disclaimer, the term of this patent is extended or adjusted under 35 U.S.C. 154(b) by 231 days.

This patent is subject to a terminal disclaimer.

(21) Appl. No.: 13/479,704

(22) Filed: May 24, 2012

(65) Prior Publication Data

US 2012/0250302 A1 Oct. 4, 2012

Related U.S. Application Data

(63) Continuation-in-part of application No. 13/041,807, filed on Mar. 7, 2011, now Pat. No. 8,616,730.

(51) Int. Cl.

| | |
|---|---|
| ***F21V 15/015*** | (2006.01) |
| ***F21S 8/04*** | (2006.01) |
| ***F21V 31/00*** | (2006.01) |
| ***F21S 8/06*** | (2006.01) |
| *F21Y 103/00* | (2006.01) |

(52) U.S. Cl.

CPC ..... *F21S 8/06* (2013.01); *F21Y 2103/00* (2013.01); *F21S 8/046* (2013.01); *F21V 15/015* (2013.01); *F21V 31/005* (2013.01)

USPC ..... 362/223; 362/267; 362/225

(58) Field of Classification Search

USPC ..... 362/223, 267, 225, 260, 249.02, 362/217.1–217.17, 368, 404, 147

See application file for complete search history.

(56) References Cited

U.S. PATENT DOCUMENTS

| | | | | |
|---|---|---|---|---|
| 4,814,954 | A * | 3/1989 | Spitz | 362/217.07 |
| 4,858,087 | A * | 8/1989 | Hartshorn | 362/219 |
| 4,866,584 | A | 9/1989 | Plewman | |
| 5,437,504 | A | 8/1995 | Halvatzis | |
| 5,716,123 | A | 2/1998 | Lamming | |
| 6,132,061 | A | 10/2000 | Andrus et al. | |
| 6,135,613 | A | 10/2000 | Bodell et al. | |

(Continued)

OTHER PUBLICATIONS

Edwards, "U.S. Appl. No. 29/386,937, Lighting Fixture With Tubular Lens", Mar. 7, 2011.

(Continued)

*Primary Examiner* — Bao Q Truong

(74) *Attorney, Agent, or Firm* — Loginov & Associates, PLLC; William A. Loginov

(57) ABSTRACT

This invention provides a vapor-tight luminaire with a housing that defines a continuous and unbroken sealed tubular lens extending in a longitudinal direction. The housing includes a pair of end cap structures removably and sealably mounted on each of opposing respective housing ends. The housing removably supports a lamp assembly that can include various reflector arrangements. The lamp assembly can include fluorescent tubular lamps and can include electronics, such as a ballast circuit. Illustratively, a supporting rail suspended from each of the opposing housing ends by respective posts slidably supports the lamp assembly. In this manner each of the housing and the lamp assembly are constructed and arranged to allow the lamp assembly to be passed into and out of the housing along the supporting rail when at least one of the end cap structures is removed from the respective one of the housing ends.

19 Claims, 29 Drawing Sheets

(56) References Cited

U.S. PATENT DOCUMENTS

| | | | |
|---|---|---|---|
| 6,193,394 | B1 | 2/2001 | Herst et al. |
| 6,386,736 | B1 | 5/2002 | Reiff et al. |
| 6,425,681 | B1 | 7/2002 | Agabekov |
| 6,561,676 | B1 | 5/2003 | Fischer et al. |
| 6,749,322 | B2 | 6/2004 | Chen |
| 6,776,504 | B2 | 8/2004 | Sloan et al. |
| 6,871,981 | B2 | 3/2005 | Alexanderson et al. |
| 6,962,425 | B1 | 11/2005 | Rhee |
| 6,979,097 | B2 | 12/2005 | Elam et al. |
| 7,245,069 | B2 | 7/2007 | Elvin |
| D549,382 | S | 8/2007 | Lee |
| 7,284,878 | B2 | 10/2007 | Dorogi et al. |
| 7,300,180 | B2 | 11/2007 | Hutchison et al. |
| 7,303,310 | B2 | 12/2007 | You et al. |
| D589,199 | S | 3/2009 | Pedersen |
| 7,513,675 | B2 | 4/2009 | Mier-Langner et al. |
| 7,524,090 | B2 | 4/2009 | Hargreaves |
| 7,674,005 | B2 | 3/2010 | Chung et al. |
| 8,235,545 | B2 | 8/2012 | Zheng et al. |
| 8,459,831 | B2 | 6/2013 | Hsia et al. |
| 8,616,730 | B2 * | 12/2013 | Edwards et al. ..... 362/267 |
| 2006/0198132 | A1 | 9/2006 | Trigiani et al. |
| 2008/0285266 | A1 | 11/2008 | Thomas |
| 2010/0085768 | A1 | 4/2010 | Pickett et al. |
| 2010/0214785 | A1 | 8/2010 | Chen |
| 2010/0253226 | A1 | 10/2010 | Oki |
| 2010/0271812 | A1 | 10/2010 | Harnischmacher et al. |
| 2010/0271825 | A1 | 10/2010 | Black et al. |
| 2011/0012531 | A1 | 1/2011 | Zheng |

OTHER PUBLICATIONS

Edwards, "U.S. Appl. No. 29/386,949, Endcap for a Lighting Fixture With Tubular Lens", Mar. 7, 2011.

Edwards, "U.S. Appl. No. 29/386,951, Housing Assembly for a Lighting Fixture", Mar. 7, 2011.

Katz, "U.S. Appl. No. 29/395,953, Housing End for Lighting Fixture", Mar. 7, 2011.

"Enclosed & Gasketed Acrylic Tube, Severe Environment", Feb. 9, 2010, Publisher: Columbia Lighting, Published in: US.

* cited by examiner

VAPOR-TIGHT LIGHTING FIXTURE

RELATED APPLICATIONS

This application is a continuation-in-part of U.S. patent application Ser. No. 13/041,807, filed Mar. 7, 2011, entitled VAPOR-TIGHT LIGHTING FIXTURE, by Richard D. Edwards, Jr. and Stanley A. Katz, the entire disclosure of which is herein incorporated by reference.

FIELD OF THE INVENTION

This invention relates to lighting fixtures/luminaries for commercial and industrial applications and more particularly to high-energy-efficiency lighting fixtures.

BACKGROUND OF THE INVENTION

Traditional high-intensity luminaries (also popularly termed "fixtures") for installation in various indoor, outdoor and indoor/outdoor (e.g. parking areas) environments are weatherproof, having durable sealed lens covers that keep moisture, vapor and other contaminants away from their internal lamps, wiring and electrical components. Such luminaries are commonly termed "vapor-tight" fixtures/luminaries. These luminaries generally include a fluorescent lamp assembly within their housing. Currently available designs define a "clamshell" consisting of an elongated, opaque, upper box (typically of polymer material), having pendant mounting brackets, attached electronics (ballast, etc.), wiring, reflector assembly and a plurality of fluorescent lamps in a predetermined number and arrangement; a translucent lower lens having a top edge that mates with the bottom edge of the upper box; and a horizontally oriented and elongated sealing surface created by the upper housing and lower lens mating surfaces. This interface between the upper and lower portions of the luminaire incorporates an elastomeric-type gasket that creates a moisture and dust-resistant seal when a set of housing affixed sealing clamps are employed to compressibly join the housing and lens portions of the luminaire. However, the seal is subject to the effects of aging, and eventually fails over time. This is partially the result of the spacing between sealing clamps and the elongated nature of the horizontal sealing surface (which provides an uneven compression to the joint line) combined with aging of the materials, environmental changes and extremes in temperature. As the seal degrades it allows for the undesirable infiltration of moisture and contaminants. Because the seal is elongated and horizontal, it encourages the buildup and retention of moisture at the seal interface around the perimeter. The moisture seeks a lower level, which it achieves by migrating through any gaps in the seal around the relatively large and intermittently clamped perimeter. Once the moisture enters, it pools in the lens, causing fogging, staining of the lens and eventual failure of the wiring and electronics.

Shortened lamp and electronics (ballast, etc.) life due to moisture-based deterioration increases the costs of maintaining the luminaries, and shortened unit life leads to more frequent replacements and higher costs for the facility owner/operator.

A vapor-tight luminaire with an advanced and efficient reflector and lamp arrangement is provided in commonly assigned U.S. Pat. No. 7,588,347, entitled LIGHTING FIXTURE, by Richard D. Edwards, Jr., which is incorporated herein by reference as useful background information. This design provides superior optimetrics with two or three fluorescent lamps. However, it relies upon existing vapor-tight housing technology which has the disadvantages described generally above. Likewise, such "clamshell" housing designs are not adapted for upgrade to different lamp arrangements that may become available and/or desiravle over time—for example, upgrading to a different number/type of fluorescent bulbs.

It is, thus, highly desirable to provide a luminaire that uses fluorescent tubular lamps, or another type of elongated light source, which is vapor tight and reduces the deleterious effects on the housing and electronics brought upon by environmental conditions, among other factors. In particular, this luminaire should employ a housing arrangement that avoids the disadvantages of an elongated, horizontal intermittently clamped seal that is prone to accumulate moisture and allow it to migrate through a gap. This luminaire should be able to employ an advanced and efficient lamp arrangement and reflector design, and afford superior photometrics. This luminaire should be easily retrofit into existing structures in a variety of mounting arrangements, such as direct-to-ceiling, pendant, etc. Moreover, the underlying housing structure should allow for straightforward mounting and removal (i.e. upgrade) of a variety of lamp designs within a single housing enclosure.

SUMMARY OF THE INVENTION

This invention overcomes disadvantages of the prior art by providing a vapor-tight luminaire with a housing that defines a continuous and unbroken sealed tubular lens extending in a longitudinal direction. The housing includes a pair of end cap structures removably and sealably mounted on each of opposing respective housing ends. The housing removably supports a lamp assembly that can include various reflector arrangements. The lamp assembly can include fluorescent tubular lamps and can include electronics, such as a ballast circuit. Illustratively, a supporting rail suspended from each of the opposing housing ends by respective posts slidably supports the lamp assembly. In this manner each of the housing and the lamp assembly are constructed and arranged to allow the lamp assembly to be passed into and out of the housing along the supporting rail when at least one of the end cap structures is removed from the respective one of the housing ends. Illustratively, a plurality of rods extend between each of the housing ends in the longitudinal direction and that provide compression between each of the housing ends and an adjacent edge of the tubular lens. In general, the lens can be constructed from a polymer (or equivalent) material with light-transmissive properties along at least a portion of its perimeter and/or length.

In further illustrative embodiments, the tubular lens includes an opaque top section formed as a co-extrusion or using a separate overlay material and/or plate that shields the ceiling from projected light. Likewise, at least one of the end cap structures defines an interior volume that extends outward from the respective one of the housing end. One or both end cap structures can illustratively define a light-transmissive dome. This dome can be covered in part with a metal framework in the form of a bezel. The bezel and the dome are secured to the housing end using fasteners that also compress a sealing gasket therebetween. A gasket is also provided between the housing end and the respective end of the lens. This gasket is compressed by tightening the rods that extend along the longitudinal direction between the housing ends. Illustratively, the lamp assembly includes a first part of an electrical connector assembly and the interconnecting harness includes a second, mating, part of the electrical connector assembly, the electrical connector assembly residing in the volume of one of the end cap structure. The harness cable can include a first end connector that removably interconnects with a second end connector on the lamp assembly, the second end connector being operatively connected to each of electronics and lamps within the lamp assembly. Also, the electronics of the luminaire can include a ballast mounted on the lamp assembly and the lamps can be a plurality of tubular fluorescent lamps (e.g. T-5 bulbs). In various embodiments, the tubular lens defines an ovular cross section along a plane perpendicular to the longitudinal direction. Other cross sectional shapes for the tubular lens (e.g. square, rectangular, polygonal, etc.) are also contemplated in various embodiments. In various embodiments, the lens can include a plurality of fluting formations extending in a direction of the longitudinal direction at predetermined locations about a perimeter of the lens. These help to diffuse light at different locations along the overall perimeter of the lens to achieve a desired projection pattern/optimetrics.

Illustratively, the lamp assembly can also include a locking mechanism that selectively secures the lamp assembly against sliding along the rail during normal use. This locking mechanism illustratively includes a winged screw that engages an end plate on the lamp assembly. At least a portion of the lamp assembly can be constructed as a metal extrusion including a main, slotted channel for engaging the rail and additional channels for receiving threaded fasteners thereinto. This member provides a strong "backbone" for the assembly where it slidably engages the rail. The tubular lens can optionally include an opaque top section, formed as a co-extrusion or using a separate overlay material and/or plate. More generally, an overlay (e.g. a flexible polymer sheet) can be removably located against an interior surface of the lens around at least a portion of a perimeter thereof, the overlay defining a surface that alters the transmission of light through the lens. In this manner the optimetrics and/or diffusive property of the lens can be customized without (free of) changing the lens design itself.

In another illustrative embodiment, a method for replacing or retrofitting a lamp assembly in a luminaire is provided. This method includes providing (a) a vapor-tight lower housing defining a continuous and unbroken sealed tubular lens having a pair of end cap structures and a lamp assembly contained therein, and (b) an interconnecting harness between the housing and the lamp assembly. An end cap is respectively removed from at least one of the end cap structures to define an end opening in the lower housing. The lamp assembly is then disconnected from the interconnecting harness. The lamp assembly is then slid through the end opening and out of the lower housing. Then, a replacement lamp assembly is slid through the end opening and into a final position therein. The harness is interconnected to the replacement lamp assembly using the mating, (multi-pin) connectors. Then, the end cap that was removed is reattached to the end cap structure to again form a vapor-tight seal at the lower housing. As defined herein, the "replacement lamp assembly" can be the same lamp assembly as was removed, potentially after service and/or inspection has been performed. Alternatively, the replacement lamp assembly can be a new lamp assembly with the same or different lamp arrangement, electronics, reflector arrangement, optimetrics and/or lamp type.

BRIEF DESCRIPTION OF THE DRAWINGS

The invention description below refers to the accompanying drawings, of which.

DETAILED DESCRIPTION

I. Overview of Two-Housing Vapor-Tight Embodiment

Figure 1:
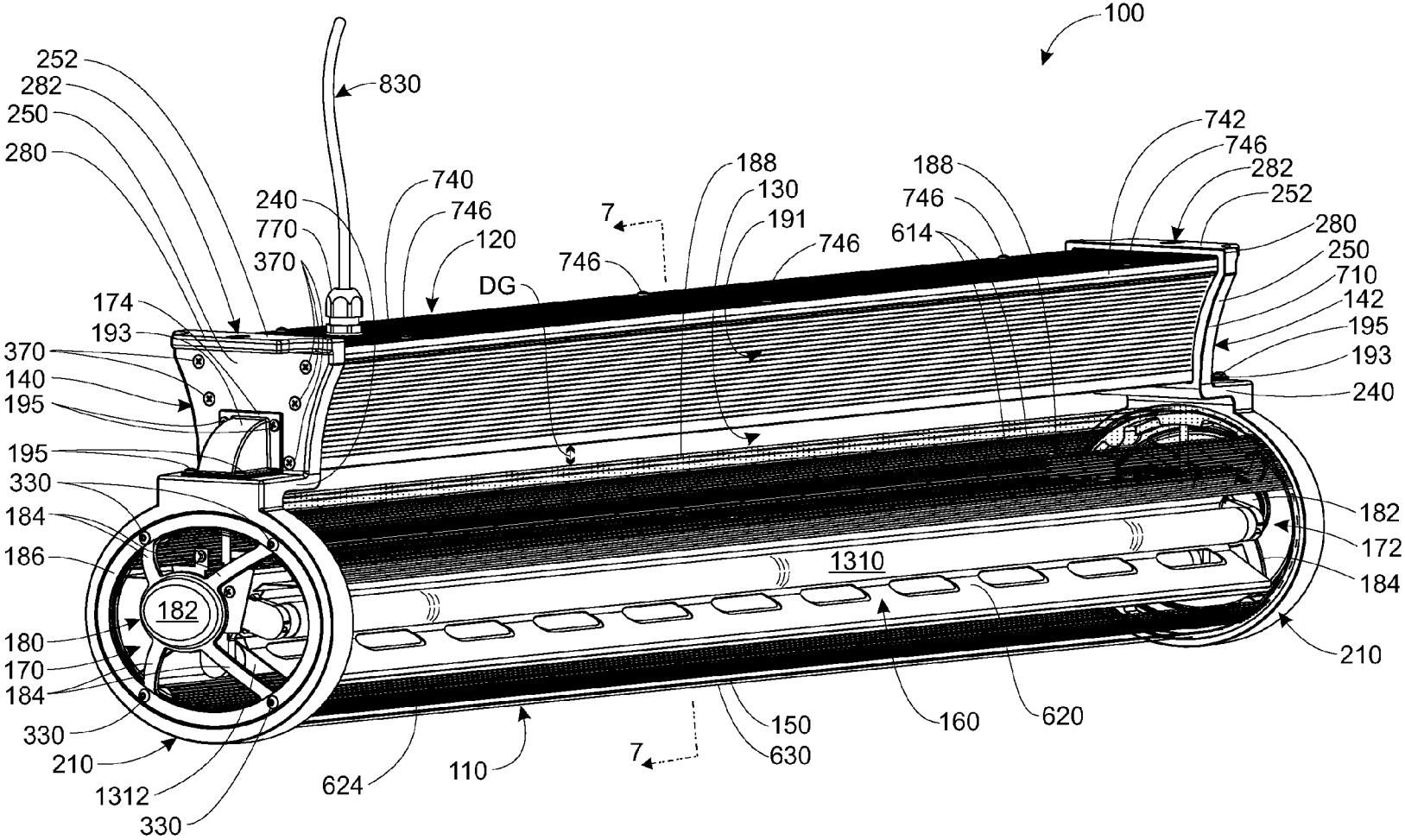
FIG. 1 is a perspective view of a two-housing vapor-tight luminaire according to an embodiment employing a plurality of fluorescent lamps in a removable reflector and lamp assembly.

By way of useful background, and to further understand the below-described illustrative embodiment, reference is first made to an embodiment of the luminaire (light fixture) according to the above-incorporated-by-reference, co-pending U.S. patent application Ser. No. 13/041,807, filed Mar. 7, 2011, entitled VAPOR-TIGHT LIGHTING FIXTURE by Richard D. Edwards, Jr. and Stanley A. Katz. The depicted embodiment is shown in assembled form in FIG. 1 and in exploded view (with reflector and lamp assembly omitted) in FIG. 3. This novel luminaire 100 includes a main light source housing 110 (also termed "main housing" or "lower housing") and an electronics and/or ballast housing 120 (also termed "upper housing") that is suspended above and separated from the main housing 110 with a gap or airspace 130 that runs the length of each housing between opposing housing end structures (or "housing ends") 140 and 142. The housing ends 140, 142, maintain the alignment between the upper and lower housings and provide the units overall structural integrity as described further below. Illustratively, the gap 130 has a vertical distance DG between the confronting housing surfaces of approximately ¼ to 1½ inches. Other gap distances are expressly contemplated. The gap is generally small enough to prevent wildlife (birds, rodents, etc) from building seats above the lower housing, which can be a particular concern where the housing includes warm-running lamps, such as LEDs or incandescents. Nests can be a significant fire hazard in such instances and reduce the heat-transfer efficiency of the lower housing. The gap 130 can comprise air or any other appropriate insulating material so as to separate the upper housing 120 from the lower housing 110. The gap 130 can be defined substantially along the entire length between each housing, or can include non-penetrating spacers or non-penetrating brackets that separate the upper housing 120 from the lower housing 110 without penetrating the lens 150. In general, it is desirable to avoid penetrating the lens along its length so as to avoid eventual and inevitable degradation/failure of a seal around a penetration, which leads to loss of vapor-tightness.

Note that directional terms such as "upper", "lower", "top", "bottom", "vertical", "horizontal", "right", "left", and the like, should be taken as relative directions only, and with reference to the depictions in the figures, rather than as absolute directions with respect to the orientation of gravity.

The main lamp/reflector housing 110 and the electronics housing 120 are collectively secured together by the two housing ends 140 that allow for the continuous gap 130 along the length of each housing 110, 120 by carrying the structural load of the overall luminaire 100 and maintaining the parallel alignment of the two housings. The left housing end 140 (the right housing end 142 being a mirror image) is shown in further detail with reference also to FIGS. 2 and 2A. Each housing end 140, 142 can be constructed from a durable material as a molded part, machined part or casting (or using another acceptable construction technique). In an embodiment the housing ends 140, 142 are constructed from cast or forged aluminum alloy, but can be constructed from another metal, a durable polymer or a composite (e.g. glass filled nylon, fiberglass, carbon-fiber, etc.). Appropriate machining can be used to provide the final shape and fitting bases (e.g. screw/bolt holes). As shown, the housing end 140 includes a lower ring 210 having a size and shape (ovular in this embodiment) that is adapted to fit over the end (310 in FIG. 3) of the translucent, tubular lens 150 of the main housing 110. The housing ends' (140, 142) ring section 210 defines an outer rim with an inner well (320 in FIG. 3) that snugly engages and captures the end 310 of the lens 150. A gasket 322 is illustratively provided within the well 320 in FIG. 3 at the interface between the lower ring's well 320 and the end 310 of the lens 150 to ensure a vapor-tight fit. The gasket can be constructed from a variety of durable, long-lived elastomers. Illustratively, it is constructed from a urethane foam (for example, Poron 4701-41 available from Rogers Corporation having a durometer of 24 and a density of 20) with gasket thickness of 0.125 inch (⅛ inch). As described further below, the cross section of the lens/main housing defines a generally ovular shape with a major axis oriented in the horizontal direction and the minor axis oriented in the vertical direction. The dimensions of each axis are highly variable, and are more generally chosen to provide appropriate clearance for the desired reflector and lamp assembly contained within the main housing. One such reflector and lamp assembly is the illustrative three-lamp assembly 160 depicted in FIG. 1 (and described further below). Note that the term "reflector and lamp assembly" can also be termed herein as a "lamp assembly" so as to include cases (but not be limited to) where lamps are arranged without need of reflectors.

In an embodiment, the lens 150 has a length of approximately 46.8 inches. However the length of the lens can vary in alternate embodiments. This length, along with the additional clearance provided by each housing end 140, 142, allows for the mounting of a conventional tubular fluorescent lamp in the reflector and lamp assembly 160, such as the standard 48-inch, bi-pin, T-8 fluorescent lamp with 2900-lumen average output. Other lamp types are expressly contemplated, as described further below.

Notably, the structure of the main housing 110 makes possible a highly variable cross sectional shape and size for the lens and associated components, as the structure does not rely upon a mating top and bottom clamshell arrangement as taught in the prior art. Rather, the main housing 110 and associated lens can be formed in any acceptable shape, including, circular, curvilinear, polygonal (regular or irregular), and a combination of curvilinear and polygonal (for example, substantially flat sides and an arched top and/or bottom). This is because the housing ends can support and engage the ends of a continuous, tubular lens with any form of cross sectional shape by forming each housing end's lower ring section appropriately to seat over an adjacent end of the lens. Any shape is expressly contemplated that provides a unitary tubular lens of any given cross-section and that is continuous and unbroken along its entire length so as to provide an effective seal. Moreover, the use of an elongated lens that is generally free of penetrations along its length, and an associated upper housing that does not rely on interconnections with the lens between the housing ends allows for variable-length sizing of the unit. For example, while a four-foot unit is shown in the embodiments herein, a three-foot unit, two-foot unit or one-foot unit (among other sizes) can be provided by shortening the upper housing channel member and lower housing lens. This can allow for use of the housing with shortened lamp assemblies (e.g. shorter fluorescent lamps, LED assemblies, etc.). The use of shorter or longer units can be desirable to enhance the versatility of the overall lighting system. By way of example, and as described below, the luminaire can be mounted vertically, and in certain installations a shorter version can be desirable for use as a wall sconce.

As shown, each housing end's (140, 142) lower ring section 210 is covered by a respective external, sealing end cap 170 and 172. In this embodiment each end cap 170, 172 (described further below) comprises a dome shape, with an outer perimeter edge that seats into a well 220 that is recessed within the perimeter of the housing end's lower ring section 210. The well 220 illustratively includes four inwardly bulged bases 230, each with a threaded hole 232 of appropriate size to receive a machine screw 330 (see FIG. 3) that is used to selectively hold down a portion of the end cap 170, 172. The end caps 170, 172 are each secured into the well by compression force applied by the tightened hold-down screws 330, which pass through holes (410 in FIG. 4) the end cap's outer flange ring (186) and into the aligned bracket holes 232. The well can include a gasket 340 (FIG. 3) formed from an appropriate material such as rubber, silicone, or urethane (Poron 4701-41, for example) with an illustrative thickness of approximately 0.125 inch (⅛ inch), so as to provide the desired vapor-tight seal. As shown the gasket 340 is cut to overlie the screw bases 230, and includes conforming screw holes. The seating of the gasket 340 in alignment with the housing end's (140) screw holes 232 is depicted further in FIG. 2. In an embodiment, the gasket 340 can include an adhesive that fixes it in the well 220.

Figure 4:
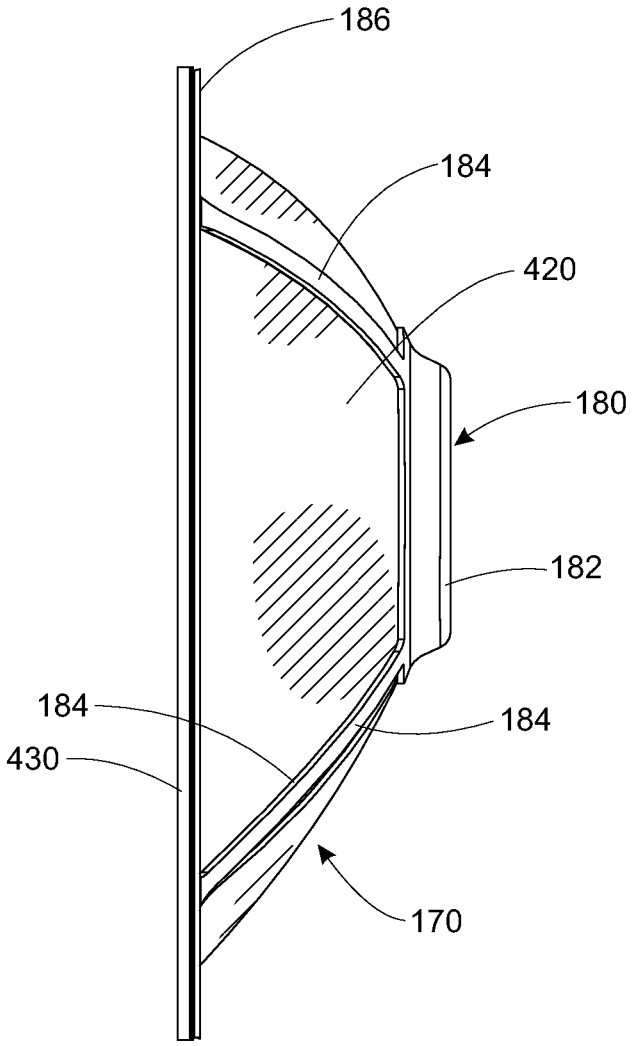
FIG. 4 is a side view of an illustrative end cap, including a translucent dome-shaped sealing cap and overlying bezel for use with the luminaire of FIG. 1.
Figure 5:
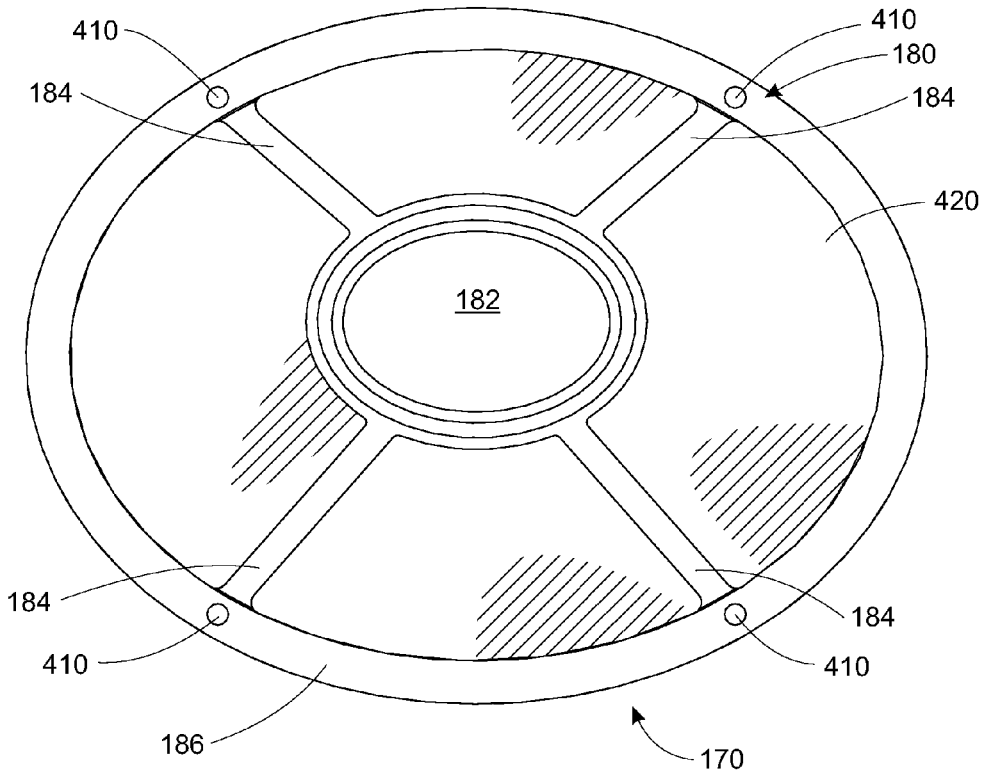
FIG. 5 is a frontal view of the end cap of FIG. 4.

Further reference is made to FIGS. 4 and 5 which show the end cap 170 (end cap 172 being a mirror image) in further detail. In an illustrative embodiment the end caps 170, 172 are provided as transparent or translucent domes 420 having a separate outer bezel 180 with a center hub 182 and four spokes 184 that extend to an outer ring 186. The bezel 180 is provides a protective and reinforcing function with respect to the underlying dome 420 in various embodiments. That is, where the dome's material may be prone to deformation and/or cracking, the bezel provides a reinforcing rib/cage structure to resist such deformation. The bezel also provides an interesting and decorative design feature. The bezel 180 can define a different shape or configuration (number of spokes, center hub size, etc.), or can be omitted in alternate embodiments, and the transparent/translucent dome (or another end cap of any appropriate shape) can be employed as a standalone end cap unit. In this embodiment the bezel 180 is constructed from stamped (or cast) steel or aluminum having an appropriate surface finish (e.g. metal-plated, polished, painted, dyed, etc.). Other appropriate materials can be used to construct the bezel in alternate embodiments including, but not limited to, another metal, composite, durable polymer or combination of such materials. The transparent/translucent dome 420 further includes a unitarily molded, flat base ring 430 at its outer perimeter that underlies the bezel's outer ring 186, and through which the hold-down screws 330 pass via holes 410 that align with the holes 232 in each housing end 140, 142. As shown in FIG. 1, this base ring 430 engages and compresses the gasket 340, and seals against the face of the well 220 in the housing end ring section 210.

The bezel's outer ring 186 provides further rigidity stability to the overall end cap assembly and ensures that the force exerted by the screws 330 is spread over the translucent dome's base ring 430 so as to avoid stress concentrations and assure that a more-even sealing pressure is applied to the underlying gasket 340. In alternate embodiments, the bezel can be all or partially omitted and the base ring of the dome can be reinforced by other forms (and/or geometries) of structures. These alternate reinforcing structures can be applied to, or integral with, the dome's base ring. Additionally, optional O-rings or other elastomeric washers (not shown) can be positioned between the heads of screws 330 and the outer ring 186. These O-rings cushion the applied force of the screws so as to prevent cracking of the dome's base ring in the event that the screws 330 are slightly over-torqued.

The sealing portions of the end caps 170, 172 (i.e. the domes 420) can be illustratively constructed in whole or part from any acceptable material with sufficient durability, service life and structural strength—for example, acrylic. However, other transparent, translucent or opaque materials, such as polycarbonate, steel, aluminum, composite (or a combination of such materials) can be used in alternate embodiments. In an embodiment, the transparent/translucent domes 420 have a thickness of approximately 0.09 inch. Different thicknesses are contemplated depending upon the material, and other decorative/structural considerations. The dome 420 is constructed by molding, but other forming processes are expressly contemplated, such as thermoforming. Each end cap 170, 172 projects outwardly approximately 1.5-1.75 inches from the adjacent housing end ring section 210, thereby providing additional clearance within the ends of the main housing 110 for electrical connections and other structures (as described further below).

Note, however, that the end caps 170, 172 can be formed in any appropriate shape, and the use of a dome shape is only illustrative. Flattened shapes, pyramidal shapes, conical shapes or rectilinear shapes can also be employed, among others. In general, the end cap should be shaped so as to provide sufficient internal clearance for elements of the reflector and lamp assembly (e.g. its electrical connections). Likewise, while the end cap 170, 172 is depicted as transparent or translucent, it can be entirely (or partially) opaque or specular in alternate embodiments. Alternatively, it can be fully or partially translucent in a contrasting color or tint relative to the main housing lens 150 (green tint, for example). Also, while four hold-down screws 330 are employed to removably secure each end cap 170, 172, the number and placement of screws is highly variable in alternate embodiments. It is expressly contemplated that alternate types of fastening mechanism can be used to secure each end cap to its associated housing end—for example a plurality of clamps located around the perimeter of the housing. Thus, as used herein, the term "fastener", can be taken broadly in this and other applications to include alternate mechanisms that removably and sealably secure the end caps to the housing ends. It is also expressly contemplated that the end caps can be radiators, fans, or any other radiative structure that allows for transfer of heat from the interior of the housing 110 to the exterior thereof.

Figure 6:
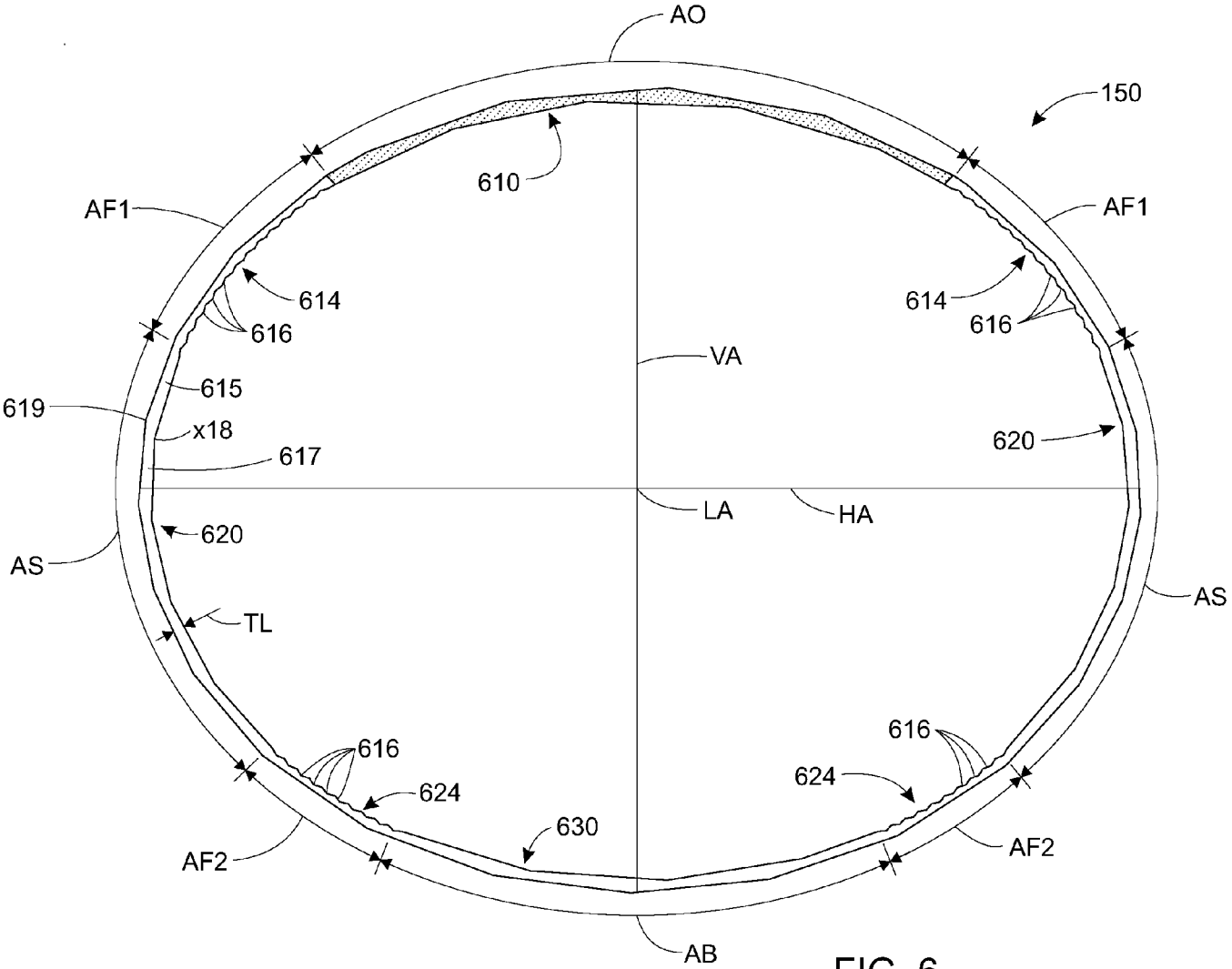
FIG. 6 is a side view section of the lens of the luminaire of FIG. 1 detailing the cross sectional geometry thereof.

Reference is now also made to FIG. 6, which details the side/cross-sectional profile of the main housing's lens 150 in accordance with an illustrative embodiment. The lens 150 is constructed of a transparent and/or translucent material, such as acrylic or polycarbonate. In an illustrative embodiment, the lens 150 can be constructed as an extrusion, which ensures a vapor-tight enclosure along its length (with the lens defining, in essence, a pipe). Any structure for the lens 150 is expressly contemplated that has a perimeter that is free of any gaps or other breaks along its length, so as to provide a lens that is continuous and unbroken about its perimeter and along its length between the ends caps. This continuous and unbroken lens maximizes the seal by the gaskets between the end caps and the lens and further ensures that the only sealing mechanism needed is at the end caps. As described below, the internal and/or external surface of the lens 150 can include a variety of light-refracting structures to diffuse and distribute the transmitted light from the enclosed reflector and lamp assembly 160. An arc (relative to the longitudinal axis LA) of approximately 90 degrees of the lens (45 degrees on each side of the vertical axis) along the top comprises a shield 188 (shown as a dot-shaded region for clarity) that is generally opaque, and prevents stray light from projecting toward the ceiling, and more generally aids in preventing an undesirable hot spot of light directly over the luminaire. This shield 188 can be constructed by co-extruding an opaque version of the lens material—for example a dyed or pigment-filled polymer. Alternatively, the shield can be constructed by applying paint or an appliqué to the lens, or the shield can be a solid plate that is mounted against the interior or exterior the lens 150. Note, in alternate embodiment the unitary or applied shield can be omitted, and/or a discrete clear/translucent lens section can be provided in the region of the upper side of the lens.

With further reference to FIG. 6, the lens' structure and associated features in this embodiment are adapted for ease of extrusion, and thus include features that run parallel with respect to the longitudinal axis LA—i.e. the direction of extrusion through an extrusion die. In this embodiment, the lens is constructed with a wall thickness TL of approximately 0.06-0.13 inch. However, a variety of thickness dimensions, as well as a varying thickness around the lens perimeter can be employed. Notably, the lens 150 is divided into various segments about the perimeter that are associated with the locations of reflectors and lamps, and designed to enhance optimetrics. As described above, the top segment 610 defines an arc angle AO of approximately 90 degrees, centered about the vertical axis VA (minor axis of the oval). This section is coextruded with the rest of the lens 150 using an opaque-colored material in an illustrative embodiment. The color is highly variable, but desirably absorbs light—for example, black or grey.

The adjacent top segments 614 of the lens 150 are fluted, using a series of 1-degree (normal to the lens inner surface), 0.02 inch linear groove features 616 that extend parallel to the longitudinal axis LA. The geometry of these light-bending/diffusive features is highly variable in alternate embodiments. In general they are adapted to provide an appropriately diffuse light and a general prismatic effect at high angles with respect to the vertical VA. The top fluted segments 616 define an arc angle AF1 of approximately 29 degrees with respect to the longitudinal axis LA.

Note that, in this embodiment, the overall perimeter lens (fluted, unfluted and opaque segments) is generally composed of a series of interconnected, approximately planar segments (facets) that join at inner and outer offset corners (for example segments 615 and 617 and corners 618 and 619). This geometry provides an interesting effect and lens appearance, but is optional. Alternatively, the lens can comprise a continuously curved perimeter wall, among other geometries.

The opposing sides of the lens define a clear, unfluted segment 620 through which the horizontal axis HA (major axis of the oval) passes. The clear sides 620 define an arc angle AS of approximately 51 degrees. The clear sides 620 allow for relatively full transmission of light from the adjacent reflector and lamps.

The lens also includes two narrower, bottom fluted segments 624, each located on an opposing side of the vertical axis VA. This segment is located relatively adjacent to the outer edge of each side of the bottom reflector assembly 1392 (described below with reference to FIGS. 13-15) so as to spread more light in this region from the bottom lamp 1312. These fluted segments 624 each define an arc angle AF2 of approximately 20 degrees. A bottom clear segment 630 of the lens 150 is located across the vertical axis VA, and defines an arc angle AB of approximately 70 degrees. In this embodiment, the vertical axis VA is approximately 6.6 inches and the horizontal axis HA is approximately 8.25 inches. It should be noted that the lens dimensions, as well as the dimensions of all segments, their number and their placement on the perimeter of the lens (the "lens feature parameters") are all highly variable in alternate embodiments. These feature parameters are dependent in part on the desired optimetrics, and taking into account the number, output and type of lamps employed, as well as the placement of reflectors surrounding the lamps. Thus, for alternate embodiments described further below, the lens feature parameters, as well as the lens cross sectional shape and dimensions, can vary to suit the particular reflector and lamp assembly described in that embodiment. Likewise, it is expressly contemplated that one or both sides of the lens can include a frosted or otherwise diffusing surface along all or a portion of the lens. This can be achieved by etching or media-blasting the associated lens surface. In an illustrative embodiment, the lens is particularly constructed of medium-impact acrylic, and the clear sections allow for approximately 92 percent light transmission while the fluted sections allow for approximately 89 percent light transmission. While extrusion is a desirable lens-formation technique, in alternate embodiments, the lens 150 can be constructed from a formed piece of sheet material that is, for example, wrapped around a mandrel or former, and welded at a seam. Other possible techniques for constructing a tubular lens of this kind should be clear to those of ordinary skill—for example, injection molding or casting.

Figure 2:
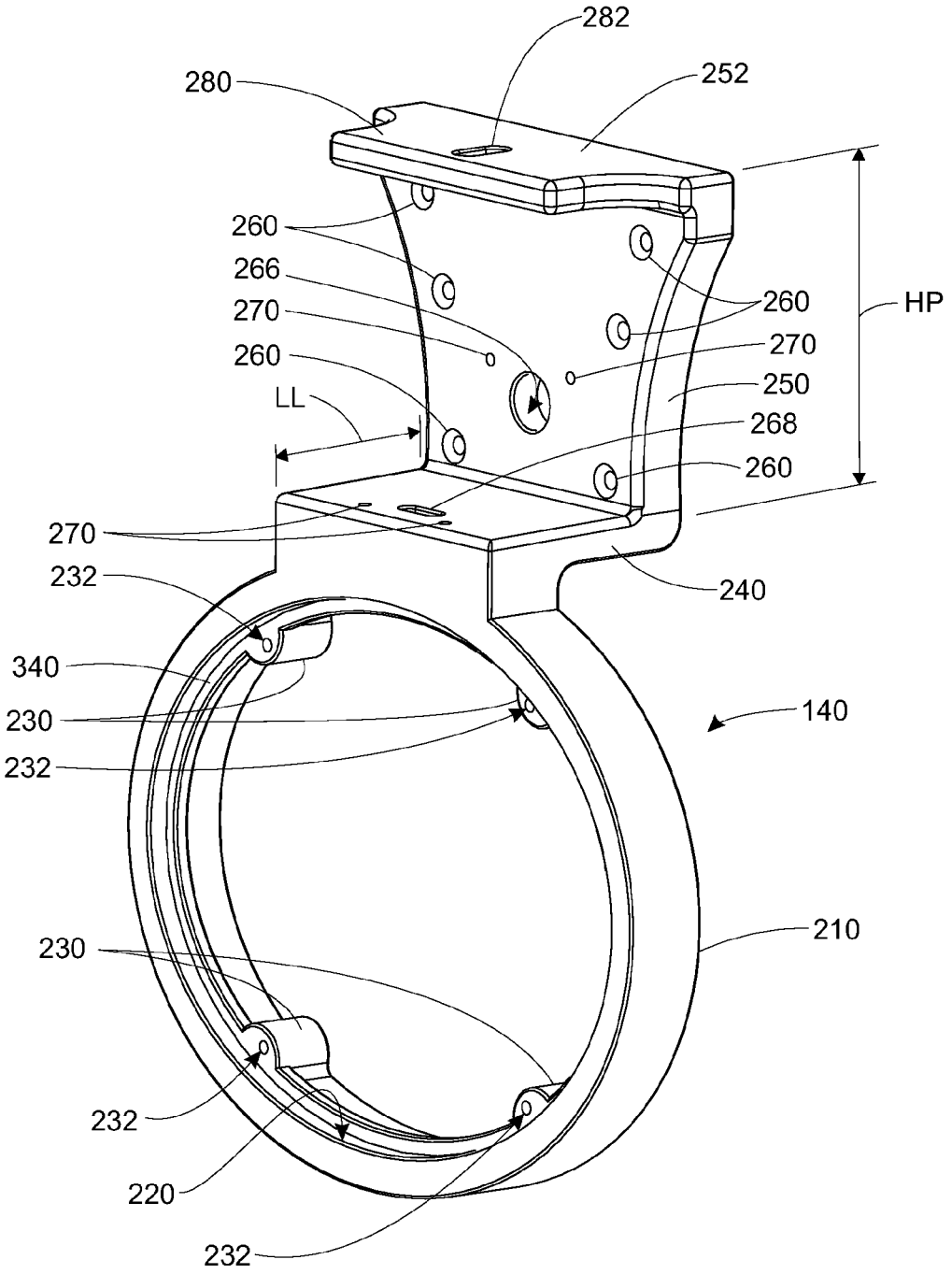
FIG. 2 is a frontal perspective view of a housing end structure for joining the upper and lower housing sections of the luminaire of FIG. 1.
Figure 2A:
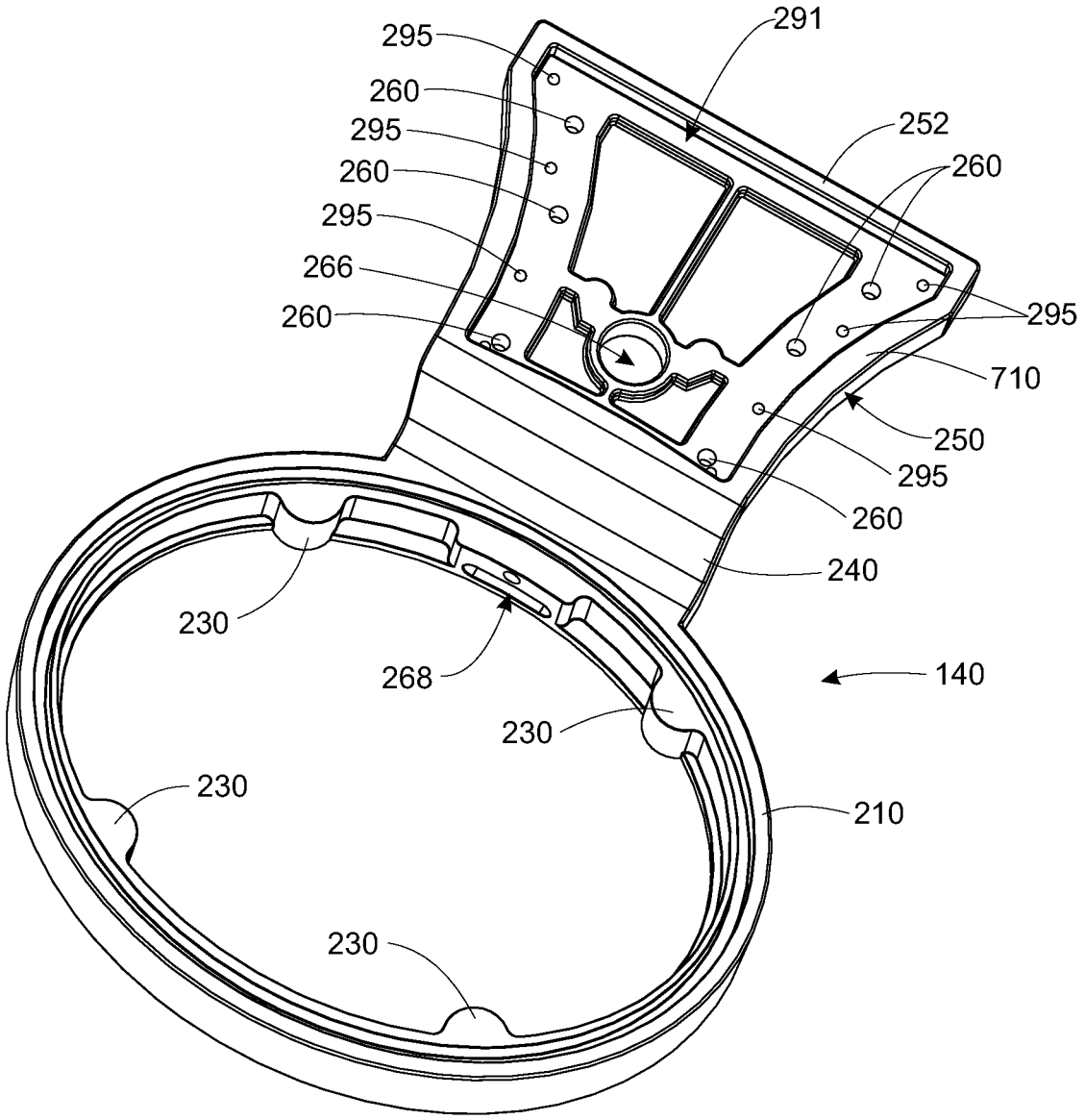
FIG. 2A is a rearward perspective view of the housing end of FIG. 2.

With reference particularly to FIG. 2, the housing end 140 is shown in further detail. The description thereof also applies to the opposing housing end 142, which is the same structure, but mounted in a reversed position on luminaire 100. Each housing end 140, 142 comprises a unitary structure that can be formed from a casting (for example, cast A380 aluminum alloy). It can be constructed from alternate materials (e.g. metals, polymers, composites or combinations thereof) using appropriate manufacturing techniques known to those of skill in the art (e.g. machining, injection-molding, etc). The housing end 140 includes an inwardly directed leg 240 above the ring 210 having a length LL of between approximately 1 and 2 inches in an illustrative embodiment. The inward end of the leg 240 is joined to a vertical end plate 250 having a somewhat upwardly flared (concave-curved-V) shape that terminates at the top end 252. This shape is in part decorative and other shapes can be provided in alternate embodiments. The vertical end plate 250 provides an encapsulating end cap for the upper/electronics housing 120. The vertical dimension (height HP) of this plate 250 is approximately 3.75-4.5 inches. It varies from a width at the bottom of approximately 3.0 inches to 3.75 inches to a width of approximately 5.0-6.0 inches at the top. These dimensions are only illustrative, and are sized and arranged to provide sufficient clearance for the electronics package 350 that is housed in the upper housing 120.

Notably, the mating surfaces on each housing end (i.e. with the upper housing's channel member, lower housing's lens, end caps and part of the covering cap 193), are all substantially vertical when the luminaire is mounted in a standard horizontal configuration. This ensures that substantially all sealing surfaces are substantially vertical, thereby enhancing the drainage of moisture from these seals and minimizing the pooling of moisture that can eventually migrate through a seal. In various embodiments, the one non-vertical sealing surface, between the cap 193 and housing end leg segment 240, can be beveled (as an option), or otherwise shaped to prevent pooling of water on the housing end leg 240 near the cap gasket 366.

Figure 7:
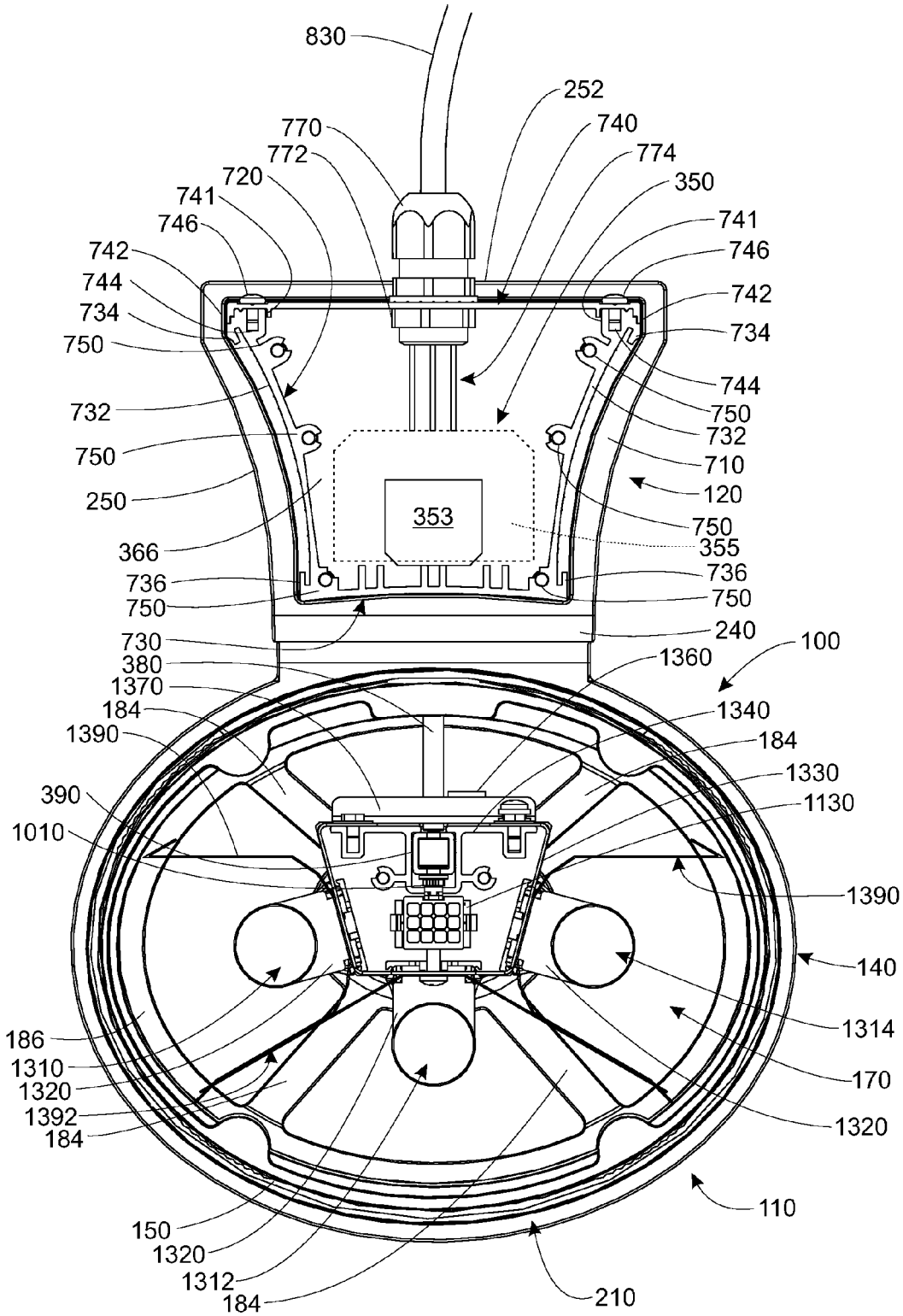
FIG. 7 is a side cross section of the luminaire taken along line 7-7 of FIG. 1.

With reference to the cross section of FIG. 7, each vertical end plate 250 provides an inner-facing well with an outer rim 710 into which a three-sided channel member 720 is seated. This channel member 720 provides the primary elongated enclosure for the upper housing 120. In cross section, the channel member 720 generally defines the concave-curved-V shape, described above, but other cross-sectional shapes are expressly contemplated. This shape conforms relatively closely to that of the rim 710. The rim 710 surrounds all four sides of the channel member 720, thereby capturing it and eliminating any lateral motion between the channel member 720 and each housing end 140, 142. The channel member 720 in this embodiment is an aluminum extrusion constructed, illustratively, from 6063 alloy. However, the channel member 720 can be formed using appropriate manufacturing methods from a variety of other metals, polymers or composite materials (or combinations thereof) in alternate embodiments. As described further below, the channel member 720 includes a bottom side 730, and a pair of side walls 732. Notably, the sidewalls contain an elongated top shoulder 734 and bottom shoulder 736, that are used to restrain an optional trim panel (191 in FIG. 1) having a predetermined pattern and/or color (such as the name of the installed location, or manufacturer). The trim panel can be constructed from any relatively thin and flexible material, and is mounted by sliding it from one side when a housing end 140 and/or 142 is detached from the channel member 720. Alternately a trim panel (191) can be attached by flexing it so that it seats within the opposing shoulders, and then allowing it to expand to lock in place. As described above, the trim panel and the associated shoulders 734, 736 are an optional feature. Moreover, the bottom shoulder 736 can be sized and arranged with a minimal height so as to avoid excess build up of moisture within its well. Slotted drains or scuppers can also be formed at predetermined intervals along the length of the bottom shoulder 736 to facilitate drainage of excess moisture.

The open top of the channel member 720 is covered with a removable top cover plate 740, that can be constructed from extruded aluminum, or another acceptable material in an appropriate thickness (for example, from 0.05-0.1 inch). The top cover plate 740 includes inner and outer skirts, 741 and 742 respectively, which surround a trough 744 that runs the length of each opposing top edge of the channel member 720. These skirts 741, 742 ensure that the top cover plate 740 is well-sealed against moisture infiltration with respect to the channel member 720. The trough 744 receives self-tapping screws (of any acceptable type) 746. The screws 746 pass through holes in the top cover plate 740, and into the trough 744, where their threads are captured and retained. The use of a trough allows placement of a varying number of screws at appropriate locations along the length of the housing 120. In an embodiment, six screws 746 (three per side are sufficient to ensure a secure fit and seal. When mounted, the opposing ends (360 in FIG. 3) of the top cover plate 740 reside beneath the top sides of (adjacent top edge 252) of the housing end's rim 710 to ensure a complete seal. The overall length (in the elongated direction) of the top cover plate 740 is selected so that, when the top cover plate 740 can be completely slid against one housing end (with the end riding under the rim, the opposing end 360 is clear of the adjacent rim, thereby allowing the top cover plate 740 to be levered into and out of engagement with the channel member 720. The top cover plate is brought to a neutral position, residing under both opposing rims 710 to secure it in place. In this position each end is at a partial standoff from the wall of the respective housing end 140, 142 with the gasket (described below) bearing on each edge of the top cover to complete the seal.

In an embodiment, the side panels 732 and/or top cover plate 740 can include elongated fins or other heat-exchanging structures that facilitate transfer of heat by radiation and convection from the upper housing's interior to the outside environment. Likewise, the top cover can be alternatively provided as a multi-section structure (not shown). This can be used to allow access to part of the housing without requiring removal of the entire top cover. An appropriate sealing structure and/or gasket can be provided between cover section joints and the fasteners can be arranged to provide sufficient hold-down pressure to each cover section.

Figure 3:
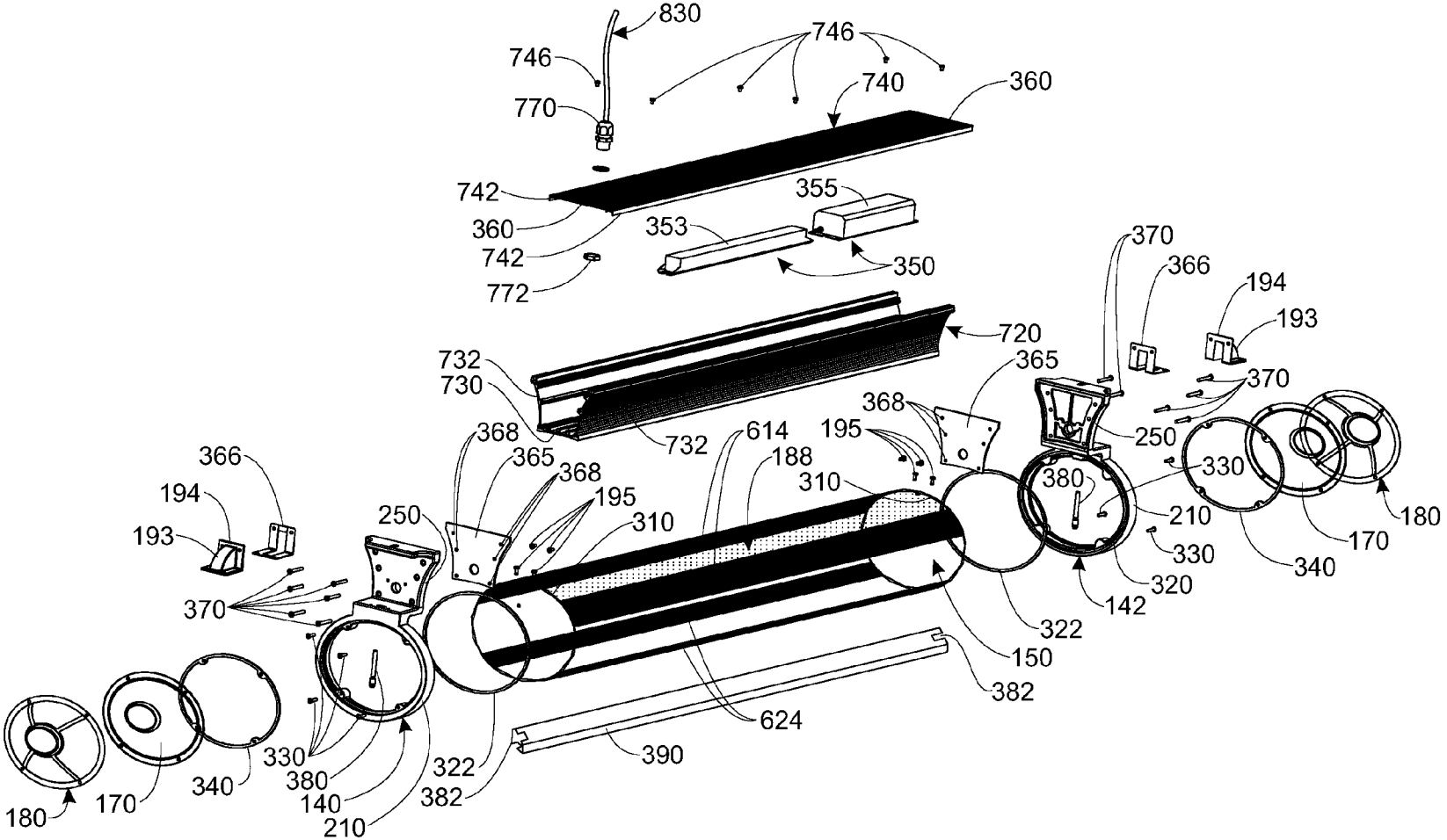
FIG. 3 is an exploded perspective view of the housing elements of the luminaire of FIG. 1 with the reflector and lamp assembly removed and omitted.

To provide the seal between the housing ends 140, 142, channel member 720 and top cover plate 740 a pair of opposing gaskets 365 (constructed for example from Poron 4701-41 or another elastomer) are provided. The gasket 365 is sized and arranged to seat snugly within the well defined by the rim 710. It has a thickness of approximately ⅛ inch in an illustrative embodiment, but this dimension is highly variable. The gasket 365 includes a series of through-holes that are aligned with countersunk screw holes 260 (FIG. 2) in the vertical end plate 250. These allow the vertical end plate 250 on each housing end 140, 142 to be securely fastened to a respective semi-circular screw receiver 750 using respective self-tapping screws 370 (FIG. 3). Each screw receiver 750 is an elongated channel that runs the length of the inner surface of the channel member 720. Each screw receiver 750 defines a central hole with an elongated cutout at the inner most edge to sufficiently surround and capture the screw, while providing a readily extruded shape. The elongated cutout slot is employed to provide clearance for the extrusion die to form the central hole feature. It should be clear that a variety of alternate fastening mechanisms, such as clamps, can be provided to secure each housing end 140 to the channel member 720 in alternate embodiments.

The vertical plate 250 also includes a through-hole 266 which aligns with a similar hole in the gasket 365. This hole 266 provides a passage for a wiring harness (i.e. a multi-conductor cable—shown as harness 1110 in FIG. 11) that electrically connects the upper housing 120 to the lower housing 110. The harness (1110) passes through a slotted hole 268 in the horizontal leg 240 of the housing end 140 (and/or 142), and exits at the inner top edge of the housing end ring section 210.

The inward recess provided by each housing end's horizontal leg 240 serves a plurality of purposes. One purpose is to provide the run for the main lamp harness (1110) in this embodiment. The harness is covered by a cast, stamped or molded cap 193 that includes a right-angle base 194. In an embodiment, the base is secured to the L-shape formed between the exterior faces of the leg 240 and plate 250 of the housing end 140, 142. The cap 193 includes sufficient interior clearance for an appropriately sized harness and it covers both holes 266 and 268. In an embodiment, the cap 193 is constructed from stamped aluminum alloy having a thickness of approximately 0.03-0.04 inch. In another embodiment, the cap is cast aluminum with an approximate thickness of ⅛-3/16 inch. However, other materials and relative dimensions can be employed in alternate embodiments (e.g. composite or injection-molded polymer). An L-shaped gasket 366 (FIG. 3) overlaps the cap base 194 and is sandwiched between the cap 193 and the faces of the housing end 140, 142. This gasket can also be formed from Poron 4701-41, having a thickness of approximately 0.04 inch. A differing elastomer and/or thickness can be used to form the gasket 366 in alternate embodiments. In this embodiment, the gasket includes an internal slot or hole on each face of its L-shape to allow passage of the harness therethrough. The cap is illustratively secured with four screws 195 that pass through the base 194 and gasket 366, into receiving holes 270 in the housing end 140, 142. Two of the holes/screws (270/195) are located along the vertical face and two of the holes/screws are located on the horizontal face of the cap base 194. Again, an alternate arrangement of fasteners and/or an alternate mechanism for covering the harness as it passes between the two housings 110, 120 can be employed in alternate embodiments. For example, a flexible, sealed conduit can be provided directly between the lens 150 and the channel member 720 in an alternate embodiment. Alternatively, an integral set of leads can be integrally constructed on or within the housing end(s) 140 and/or 142 with appropriate connectors and/or electrical leads extending from the housing end(s) into each housing.

Figure 8:
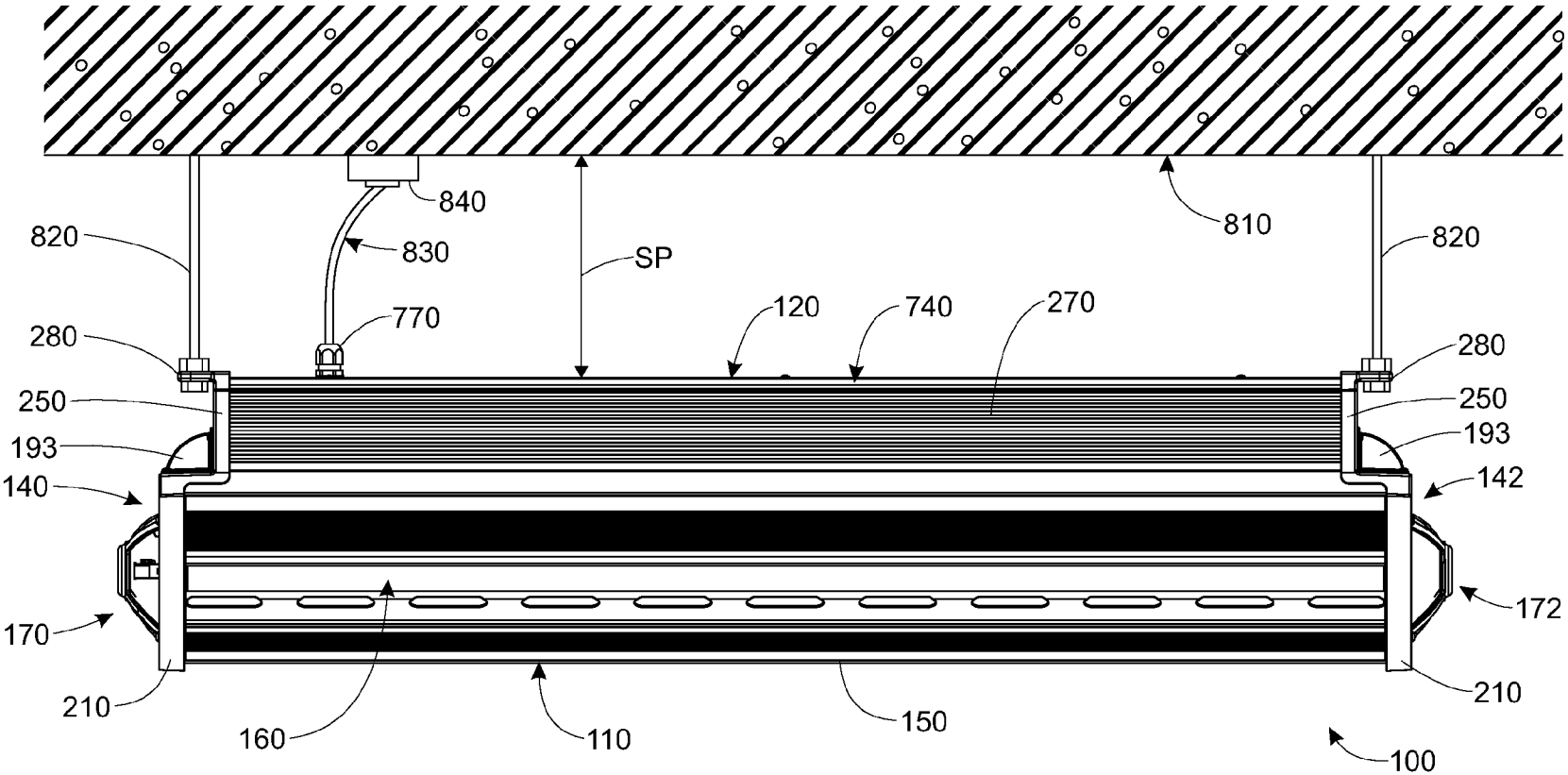
FIG. 8 is a side view of the luminaire of FIG. 1 shown mounted to a ceiling surface via posts or stanchions.

Another function of the inwardly directed leg 240 is to provide a clearance for an outwardly extended mounting base 280 at the top of each housing end 270 that overhangs the leg 240. This base 280 includes a through hole 282 that is sized to receive a post or bolt for mounting the luminaire 100 in a pendant orientation from a ceiling or other overhead structure. As shown in FIG. 8, the luminaire 100 is supported below a ceiling surface 810 in a structure such as an indoor parking facility at a spacing SP of between several inches and several feet. Support for the luminaire 100 is provided by a pair of posts 820 that include threaded ends (or are alternatively threaded along all or a substantial portion of their respective lengths), that engage the respective through holes (182) in each of the bases 280. Nuts or other securing structures can be provided above and below the base 280 to restrain lateral movement of the luminaire along each post 820. The posts are anchored in the ceiling 810 or other structure using conventional techniques. The bases 280, due to their overhang provide an accessible and convenient location for attachment to the posts 820 and subsequent adjustment. Notably, the placement of the bases allows the region overlying the top cover 740 to be free of any ceiling brackets or other mounting structures, thereby allowing for straightforward attachment and detachment of top cover while the luminaire 100 remains installed on the ceiling or other supporting structure. The positioning of the bases 280 more generally aids in initial installation, and subsequent replacement of a luminaire according to the illustrative embodiment.

In this embodiment, the electronics provided in the upper housing 120 are electrically connected with an external power source (e.g. line current at 120-277 VAC) via an external power feed (i.e. a multi-conductor cable) 830. With reference also to FIG. 7, the power feed is sealed to the top cover 740 using a conventional sealing nut assembly 770 that passes through the top cover 740. The sealing nut assembly is locked in place, in a sealed relationship (with appropriate seals and gaskets) using a locking nut 772, which engages the inner facing side of the top cover 740. The opposing end of the power feed is connected to the structure's power via a conventional connection box 840, or any other acceptable arrangement. Note that the location and arrangement of the power feed 830 is illustrative only. In alternate embodiments, the luminaire's power feed can extend from an alternate location on the housing 120, or from one of the housing ends 140, 142, among other locations. Likewise, as described below, the power feed can also include various control and data lines for use in operating the luminaire and monitoring its function (power use, temperature, ballast condition, etc.), as well as controlling and monitoring other possible functions, such as a built-in surveillance camera, microphone or loudspeaker (described further below).

While the housing ends 140, 142 shown and described herein include an offsetting leg 240, this feature is optional in alternate embodiments and an end cap with a substantially planar arrangement between the lower housing ring and upper housing plate can be provided in alternate embodiments. Appropriate wire chase holes can be formed within the housing end to allow passage of wires from the upper to the lower housing in such a planar bracket arrangement so that the lens remains free of perforation and the sealing gasket is not compromised. For example, a central bore that passes from a portion of the housing end's upper housing end plate and through the top end of the lens mounting ring can be provided. Likewise, the housing ends can define an offset in which the upper housing is longer than the lower housing in an alternate embodiment.

Figure 2B:
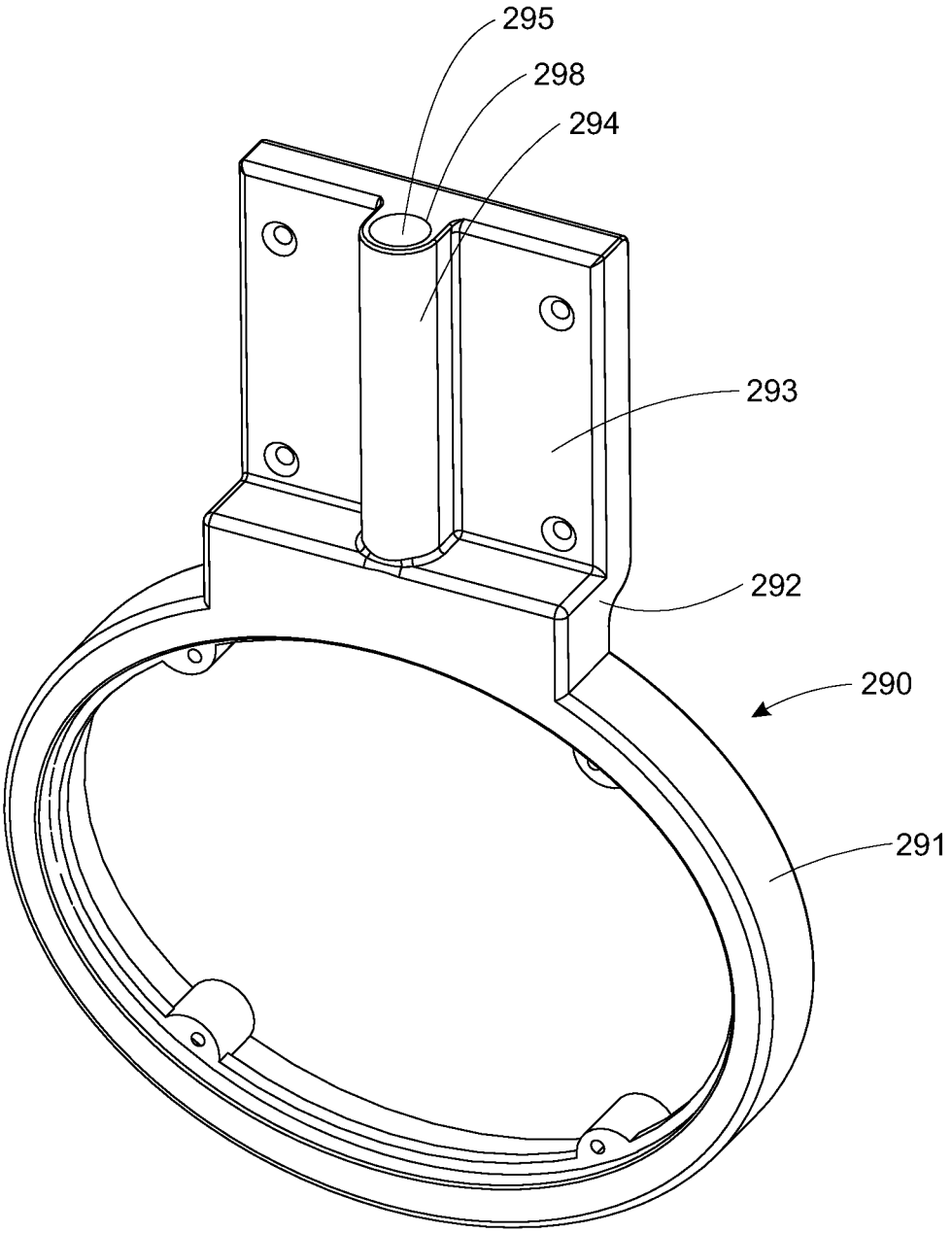
FIG. 2B is a frontal perspective view of a housing end including a unitary wiring harness chase and a shortened horizontal leg section according to an alternate embodiment.
Figure 2C:
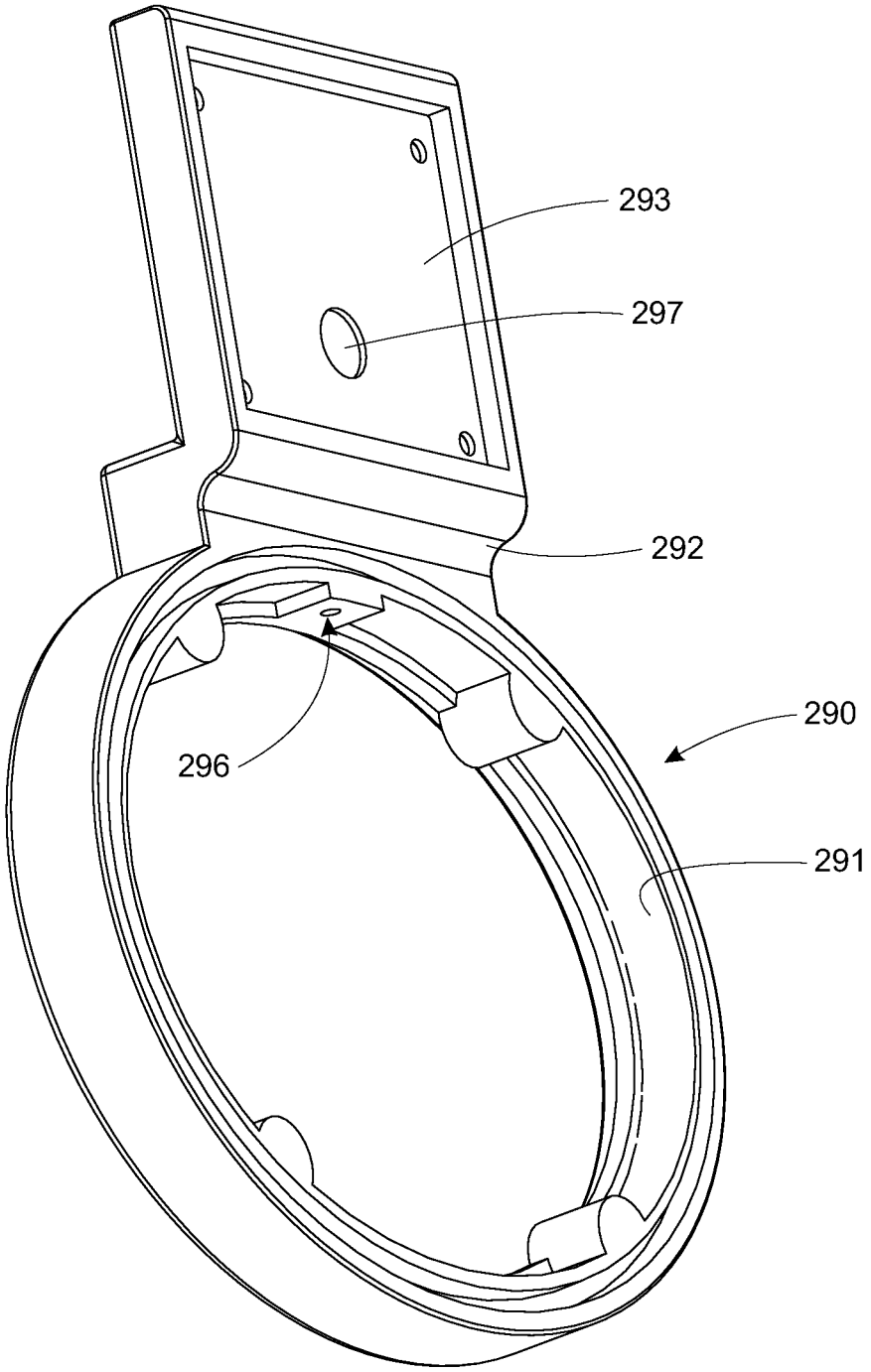
FIG. 2C is a reward perspective view of the housing end of FIG. 2B.

By way of further example, a housing end according to an alternate embodiment is shown with reference to FIGS. 2B and 2C. Like the embodiment of FIGS. 2 and 2A, this housing end 290 includes an appropriately shaped ring section for engaging a conforming lens/lower housing and supporting an appropriate end cap that can be the same, or different from those described above. A short horizontal leg 292 separates the ring 291 from the upper vertical plate 293, which is sized and arranged to engage and conforming cross-section upper/electronics housing (not shown). In this embodiment, the plate 293 defines a rectangular outline so as to engage a rectangular cross-section upper housing. The outline can be any acceptable cross-sectional shape in alternate embodiments. In this embodiment, the upper housing is longitudinally shorter than the lens by a lesser degree than the above-described embodiment. In alternate embodiments, the ring 291 and vertical plate can be sized and arranged so these housings are of approximately equal length or the lower housing is longer than the upper housing. In this embodiment, the use of a separate cap to seal off the harness is avoided using a unitarily (or integrally) cast (or machined, molded, welded-on, etc.) vertical shaft 294 that projects from the outside face of the vertical plate 293. The shaft can alternatively be part of a thickened vertical plate structure. Illustratively, the shaft encloses a bore 295 that exits the inner perimeter of the ring section 291 at a port 296. The bore 295 is intersected by another port 279 along the interior face of the vertical place 293. This port provides a chase for the wiring harness from the upper housing, through the bore 295, and out the port 296, so as to enter the lower housing. The harness chase formed by these bores and structures maintains a sealed relationship with only the top end 298 of the bore exposed to the environment. This top end 298 can be capped with a threaded plug and optional seal, such as an O-ring (providing a very reliable and long-term vapor-tight seal). The end of a ceiling-mounted rod (with appropriate seals) (or an adapter that engages the rod can also be secured to the bore end 298 via mating threads. In an embodiment, a threaded set screw is secured into the bore 295 in a position that resides above the port 297. A sealing ring or sealant can be provided to the set screw. A threaded mounting member is secured in the bore end 298 to provide a desired mounting arrangement for the luminaire after the sealing set screw is secured into the bore 295. It should be clear that a wide range of shapes and arrangements can be provided for the housing end and associated harness chase.

The electrical leads 774 (FIG. 7) of the power feed 830 are routed to the electronics 350 so as to provide line current and other electrical connections (e.g. control and data). The electronics 350 can consist of a variety of devices needed to properly distribute conditioned power to the lamps. Two alternative ballast types (electronic 353 and magnetic 355) are depicted, both fitting the interior of the upper housing with ample room for additional electronics and/or accessories. In alternate embodiments, as described below, the electronics can be any devices employed to control and optionally monitor the luminaire. For example, electronics can include appropriate remote control devices, as well as devices that send telemetry information over a wired link, or wirelessly, to a monitoring device. One such monitoring device can comprise a general purpose computer (PC) with appropriate peripherals. In addition, emergency backup power devices with appropriate batteries, etc. can be accommodated by the luminaire.

In the pendant embodiment of FIG. 8, the overall load of each housing 110, 120 is carried by the two opposing housing ends 140, 142. Thus, locating the mounting posts at these points relieves the middle sections of the luminaire from carrying the structural load of the unit. Nevertheless, the upper housing 120 is constructed and arranged to support the entire luminaire as shown in the optional mounting arrangement of FIG. 9. In this alternate arrangement, the luminaire has been mounted in close proximity to the ceiling surface 810 (or another support structure) using a pair of brackets 910 that engage the sides of the upper housing. In an embodiment, the brackets 910 include inwardly directed shoulders 928 that engage corresponding shoulders 930 formed along each side of the top edge of the channel member 270. In this manner, the brackets are free of attachment to the top cover. The brackets 910 can be formed from stamped steel or another acceptable material. They include holes or slots along their tops through which threaded rods or bolts 920 can be placed, such bolts being secured to the ceiling surface 810 as shown. This arrangement allows relatively flush mounting to the ceiling. The power feed 830 is interconnected with a junction box 942 or other structure formed on or into the ceiling 810. However, in this embodiment, a cap 940 is provided instead of the cover cap 193, and includes a port for the conventional sealing nut assembly 770. In this manner, the power feed 830 is allowed to exit through the side of the housing end 140 rather than through the top cover 740. This provides additional clearance for the run of the power feed and its interconnection with the junction box 940. The power feed 830 can be secured and sealed with respect to the housing end 140 using alternate mechanisms, such as direct mounting to the vertical plate 250. The depicted cap 940 also provides a sealed cover for the harness in this embodiment. Alternatively, the harness 1110 can be carried through a side of the luminaire separate from that of the power feed 830. The cap 940 or other structure for guiding the power feed can include appropriate gaskets such as the L-shaped gasket 366 described above. The number of brackets 910 used on a particular luminaire is highly variable, with two being the minimum number in a typical mounting arrangement. The placement of the brackets 910 along the longitudinal length of the upper housing 120 is also highly variable. Note also that the depicted brackets 910 advantageously allow for removal of the top cover (or at least one section of a multi-section top cover) due to their relative clearance from the top cover, which allows the cover to be lifted and withdrawn longitudinally within the space between the tops of the brackets and the top edge of the upper housing channel member. Likewise, the brackets 910 are free of fastening to the top cover 740, allowing for ease of removal. This is a further feature that enhances serviceability of the luminaire without need of dismounting it from a ceiling or other surface.

Figure 9:
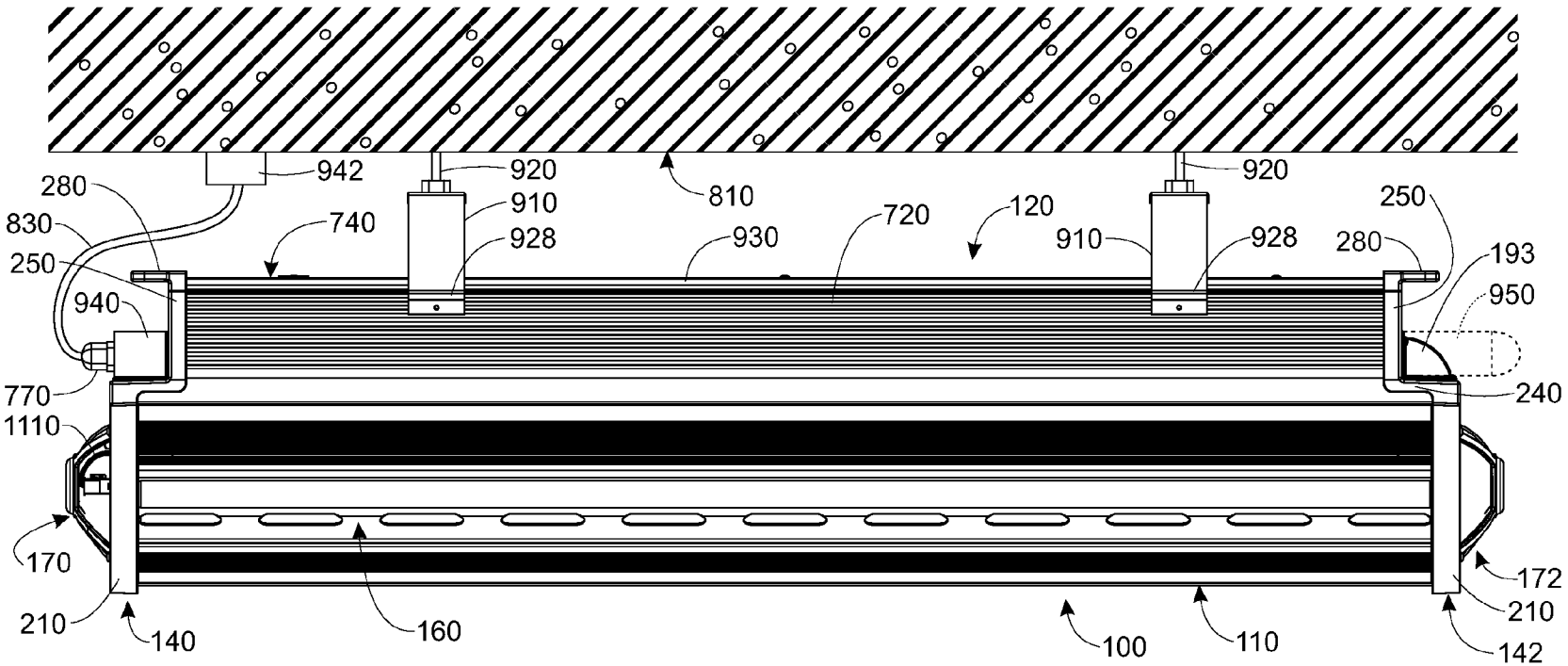
FIG. 9 is a side view of the luminaire of FIG. 1 shown flushly mounted to a ceiling surface via brackets attached to the upper housing.

As a further option for use on the depicted luminaire of FIG. 9, or any other embodiment contemplated herein, at least one housing end (142 as shown) can substitute the cover cap 193 with a mounted accessory 950 (shown in phantom). This accessory can include a gasket (like the above-described gasket 366) to seal the wire chases, and can be interconnected via an accessory harness with the upper housing, lower housing, or both, through the wire chases. The accessory can be any device that is sized and arranged to seat securely against the housing end's leg 240 and/or vertical plate 250. In this example, the accessory is a sensor or camera, but a wide variety of mountable accessories can be provided to one or both of the housing ends 140, 142. Additional fastener holes can be provided to mount accessories, or the original cover cap screw holes can be used to apply fasteners to secure the accessory.

While the luminaire 100 in the illustrative embodiments is shown in a horizontal mounting orientation with respect to a ceiling or other overhead structure, it is expressly contemplated that the luminaire can be mounted in a non-horizontal orientation—for example in a vertical wall-sconce application. The bases 280 or brackets 910 can be used to interconnect the luminaire with appropriate mounting structures (bolts, lags, etc.) on a wall surface. As described above, the length of the luminaire is highly variable, and a shortened version can be used for a wall-mounting application in various embodiments. Again, the versatility of the luminaire according to embodiments herein is substantial.

Notably, the housing ends 140, 142 are sized and arranged so that, when the gaskets 365 and 322 are in place, the action of securing the screws 370 causes the vertical plate 250 of each housing end to compress firmly against the respective end of the channel member 720. This, in turn causes the ring sections to compress against the respective end of the lens with the gasket 322 being deformed to form a vapor-tight seal. No additional fasteners or clamps are needed, so long as the dimensions of the lens and the housing ends are sufficiently precise and the housing ends are sufficiently rigid. Thus, assembly of the basic upper and lower housings into an integral unit is relatively straightforward, and disassembly of the housings from the overall unit for service and replacement of components is similarly straightforward with the removal of the screws 370 from at least one side and the withdrawal of the respective housing end from each housing 110, 120.

In the above-described mounting arrangement in which the housing ends support the upper and lower housings in a spaced apart relationship it is recognized that the lens essentially floats along its longitudinal length with little or no force applied to it by the weight of the internal components. The lens 150 is captured between the housing ends and held in place by the pressure exerted by the each housing end ring 210 on the seals and the confronting edge of the lens. This mounting and sealing arrangement not only facilitates a lens surface that is free of penetration along its length and about its perimeter, but also ensures that the sealing pressure is uniform about the entire edge of the lens at each opposing end thereof. Moreover, the pressure exerted by the sealing arrangement is directed along the longitudinal direction, which is the lens' strongest dimension (as a supporting column). This minimizes any deformation between the seal and the lens edge even when significant sealing pressure is applied by the housing ends to the lens. Conversely, the conventional clamshell arrangement is sealed along a relatively weak direction.

It is desirable that the housing ends 140, 142 are tightened onto the channel member 279 with the appropriate degree of force and in a manner that ensures that each ring 210 is substantially vertical and parallel with respect to the other ring. This ensures that the desired even sealing pressure is applied about the perimeter of each opposing edge of the lens. Reference is made again to FIG. 2A showing a rear perspective view of the housing end 140 (the opposing housing end 142 being a mirror image). The rim 710 of the vertical plate 250, which surrounds an end of the channel member 720, is shown including the fastener holes 260 that receive screws 370. As described above, the screws 370 draw the housing end 140 toward the upper housing channel member 720 to provide requisite compression force to compress the gaskets between the ring 210 and the lens edge. Because a gasket 365 resides between the inner surface 291 of the vertical plate 250 and the edge of the channel member 720, the screws may unevenly compress these two components together. Thus, a set of bumps 295 having a projection distance of approximately 1/32-3/32 inch and a diameter of approximately 1/16-3/16 inch are formed on the inner surface 291 at locations that confront the edge of the channel member when it is seated within the rim 710. The bumps 295 cause the gasket 365 to compress to a very thin profile where they contact the gasket. They essentially come into contact with the edge with a thin section of gasket therebetween. This allows the screws to be driven to a predetermined maximum torque while ensuring that the surrounding gasket is compressed to an appropriate degree, and not over-compressed by any of the screws 370. This even compression ensures that the housing end 140 (and 142) remains vertical, and that the force exerted by the ring 210 on the lens is constant and predictable about the circumference of the lens edge. In other words, the bumps act as stops to further compression of the housing ends while avoiding puncture of the underlying gasket due to the durability of the gasket material.

Figure 10:
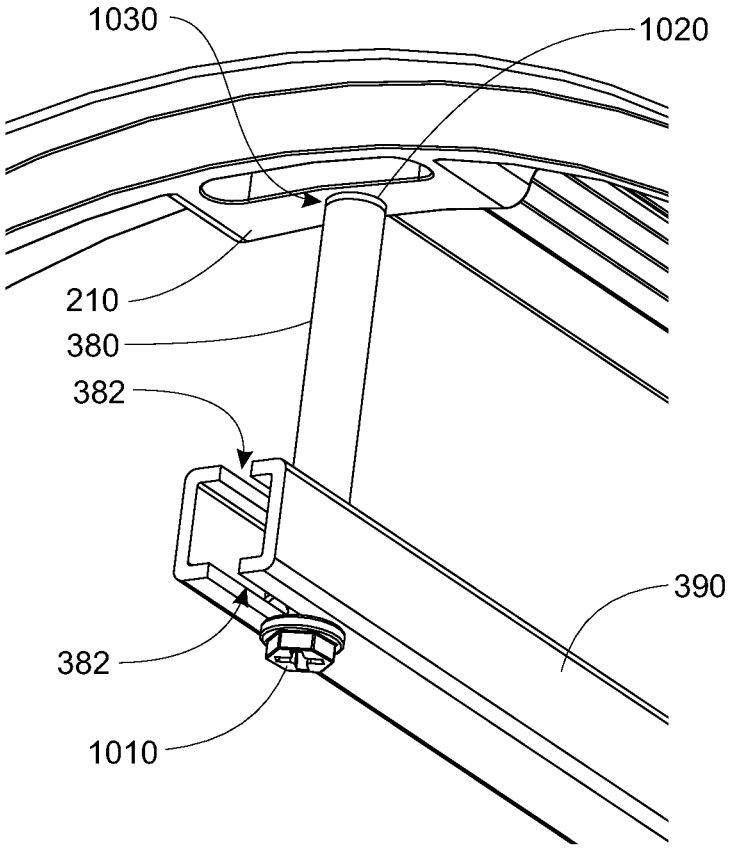
FIG. 10 is a fragmentary perspective view of the ring section of a housing end of the Luminaire of FIG. 1, showing a support post and an end of the rail upon which the reflector and lamp assembly is slidably mounted.

Reference is made to the exploded view of FIG. 3 and the fragmentary close-up view of FIG. 10, which shows a pair of posts 380, each of which is mounted on the top inner edge of a respective housing end ring section 210. The posts are slotted to receive corresponding slots 382 in a square-cross-section channel member or "rail" 390 that extends the length of the lower housing between the posts. A screw 1010 (FIG. 10) retains each end of the rail 390 with respect to the post. The post 380 can include a threaded end 1020 that is received by a threaded receiving hole 1030 in the ring section 210. When mounted, the square channel or rail 390, which can be formed from extruded carbon steel with an approximate wall thickness of 0.065 inch (or another material, such as aluminum stock). Alternatively, the rail 390 can be constructed from composite or any other acceptable material). The rail allows the reflector and lamp assembly 160 to slide into and out of the lower housing 110 and retains it securely in the housing when fully mounted. The rail is shown as a hollow square-cross section member, but can comprise an alternate shape in various embodiments (e.g. a T-shape, triangle, oval, etc.). The reflector and lamp assembly can be adapted to mate with the illustrative rail shape.

Figure 11:
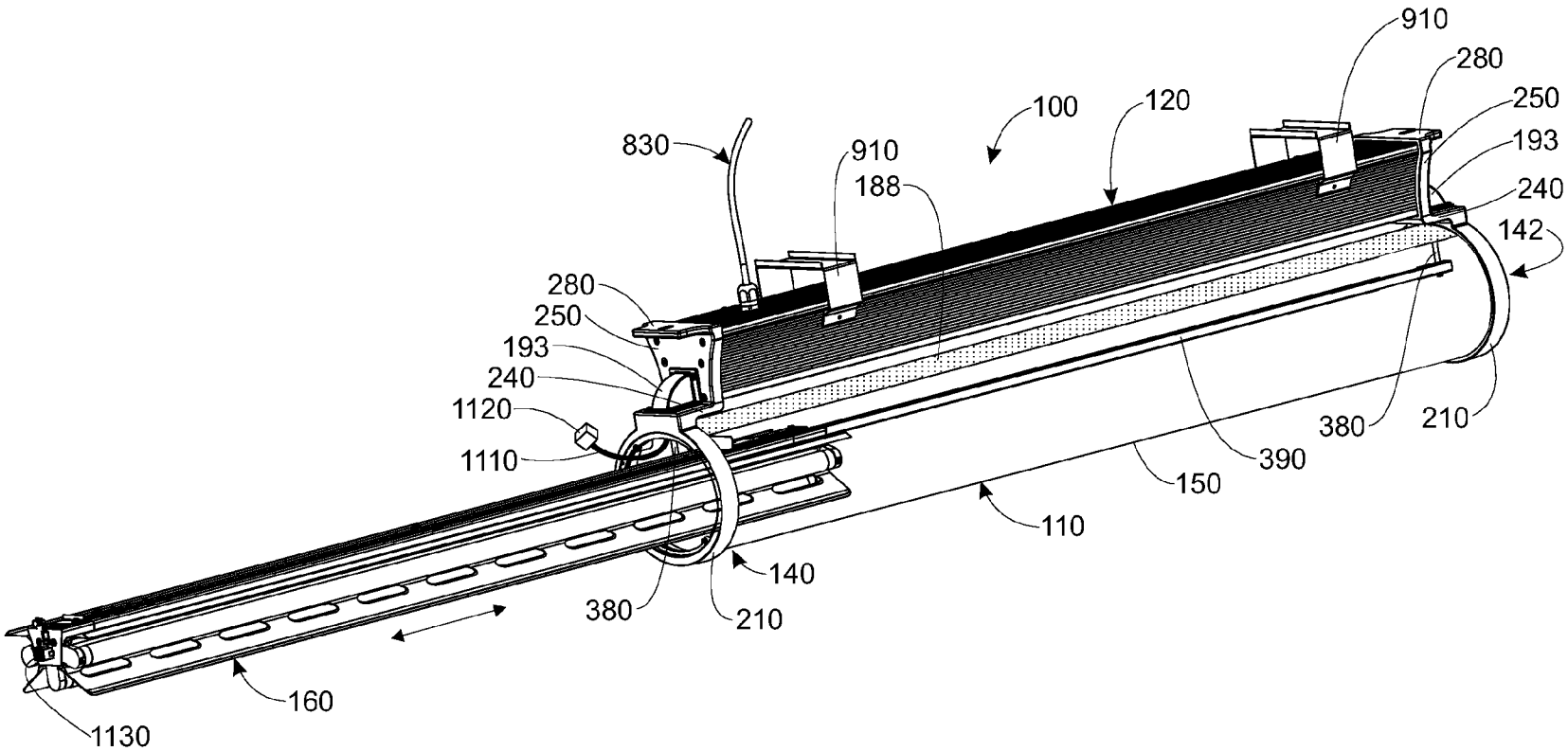
FIG. 11 is a perspective view of the luminaire of FIG. 1 showing an end cap of the lower housing removed and the reflector and lamp assembly being partially slidably moved into or out of the housing.
Figure 12:
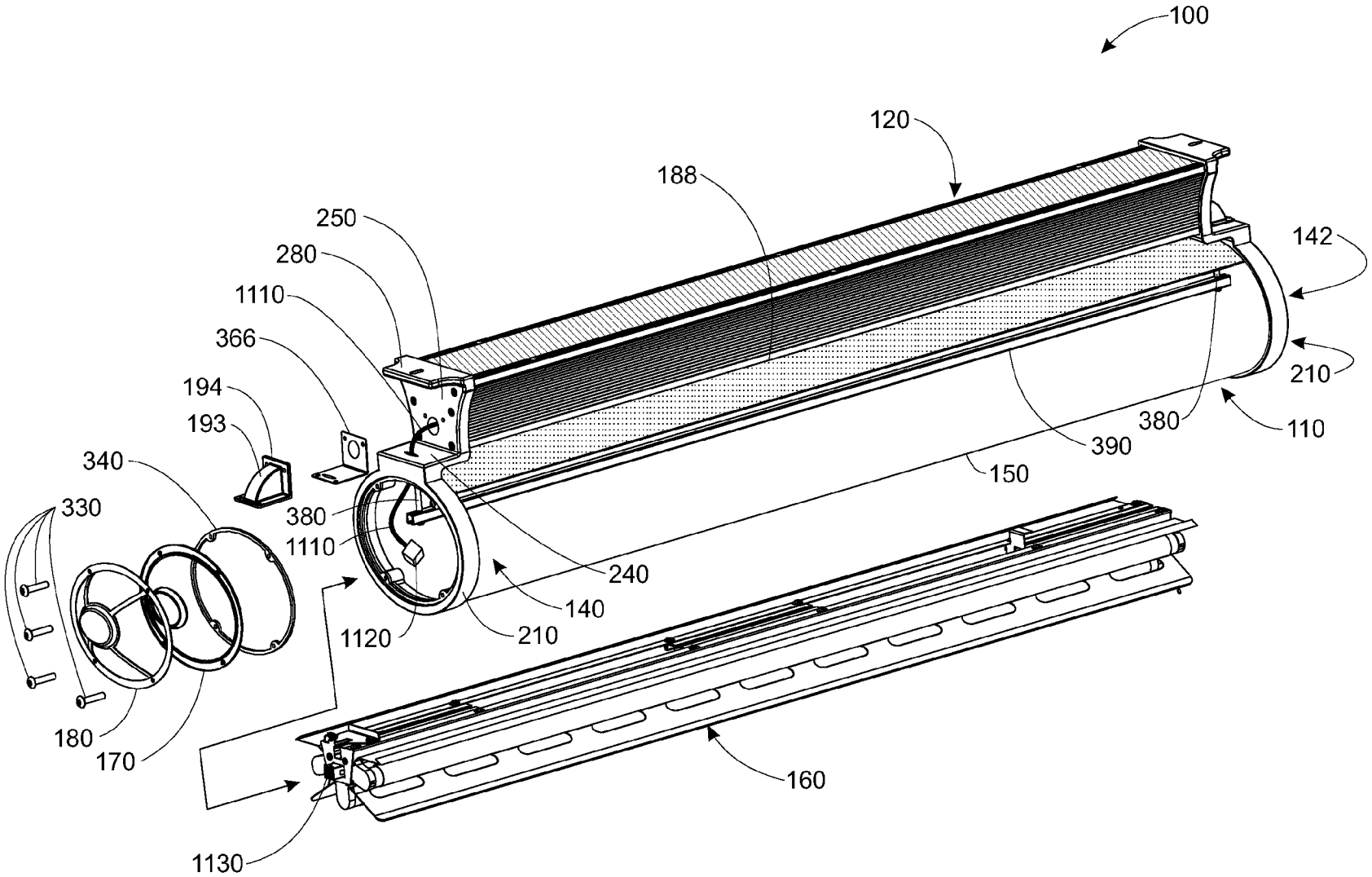
FIG. 12 is a partial perspective view of an end of the luminaire of FIG. 1 with an end cap and the reflector and lamp assembly completely removed from the lower housing, and showing the rail upon which the reflector and lamp assembly (and other light sources) are slidably mounted.

Reference is now made to FIGS. 11 and 12 which respectively show the reflector and lamp assembly 160 partially and fully removed from the lower housing 110. The reflector and lamp assembly 160 includes a central frame (described in detail below) that is sized and arranged to slide on the rail 390 so that the assembly 160 can be easily mounted in the housing by aligning an end of the frame with the rail 390 and sliding it fully into the housing 110 and engaging a locking mechanism to retain it in this position. The assembly 160 can be removed by unlocking it and drawing it down the rail until it is free of the housing as shown in FIG. 12. In attaching and removing the reflector and lamp assembly 160 a multi-pin connector 1120 on the end of the harness 1110 is manipulated with respect to a mating connector 1130 on the assembly. This connector directs power and other associated signals to each of the lamps in the assembly. The connector is 1120 is attached to the assembly's connector 1130 after mounting is complete. Likewise, the connector 1120 is detached from the assembly's connector 1130 (and the harness 1110 is moved to a non-interfering position) before the assembly 160 is withdrawn from the housing 110. The use of a novel connector system (1120, 1130) makes attachment and removal of reflector and lamp assemblies significantly more convenient as all wiring is carried through a single connector. This reduces the possibility of mis-wiring the lamps and significantly speeds the connection process. As shown, the space occupied by the joined connectors extends into the end cap (170) region, making the extended dome shape desirable to provide clearance.

Note that the luminaire 100 of FIG. 11 is shown with the optional brackets 910 described above. These brackets are shaped with an inward detent that conforms to the shape of the channel member. The brackets 910 can be secured using set screws (shown as circles on the lower end of each bracket), which engage the side of the channel member 720. It is otherwise similar in all respects to the illustrative embodiment shown in FIG. 1.

Figure 13:
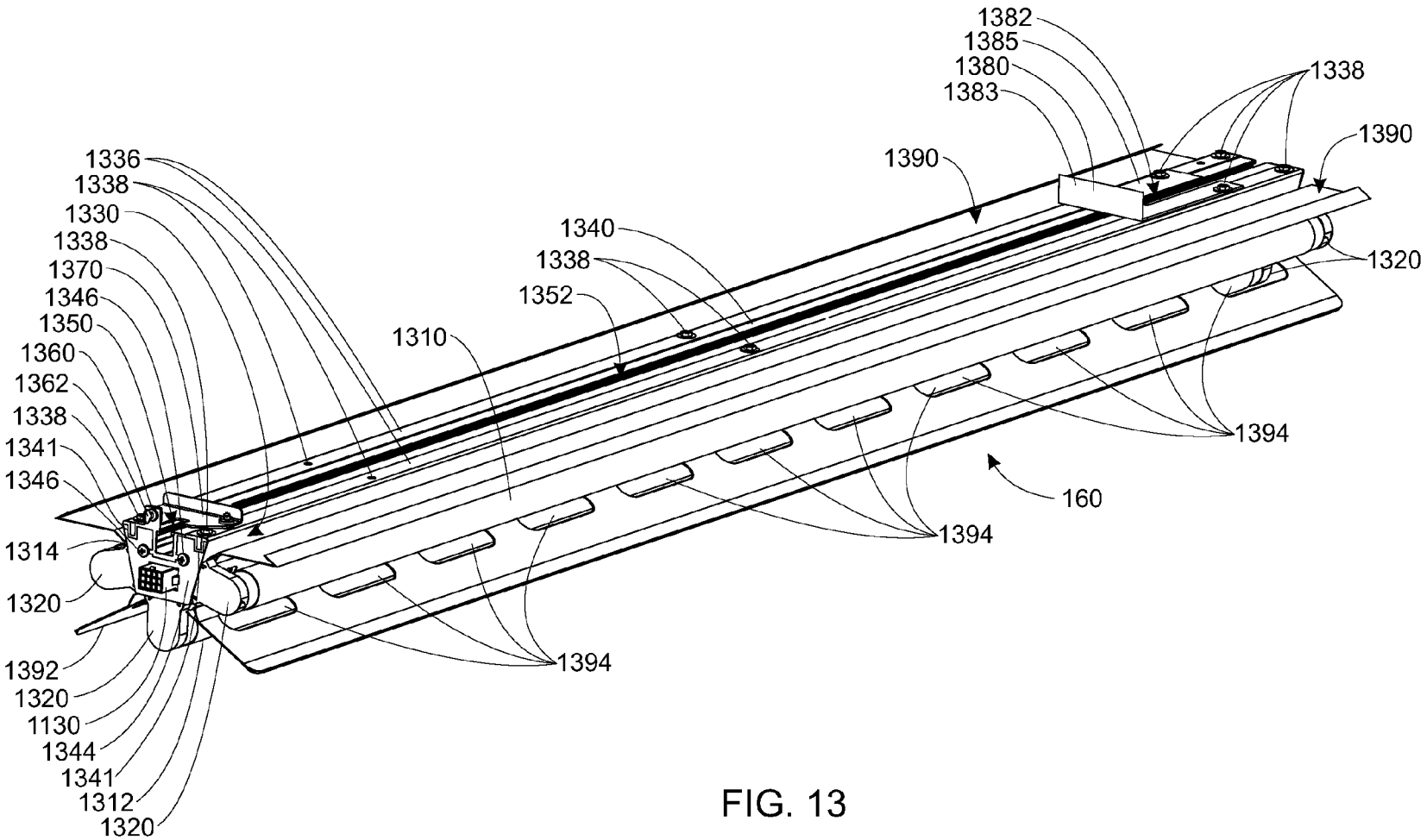
FIG. 13 is a perspective view of the reflector and lamp assembly, providing three fluorescent lamps according to an illustrative embodiment.
Figure 14:
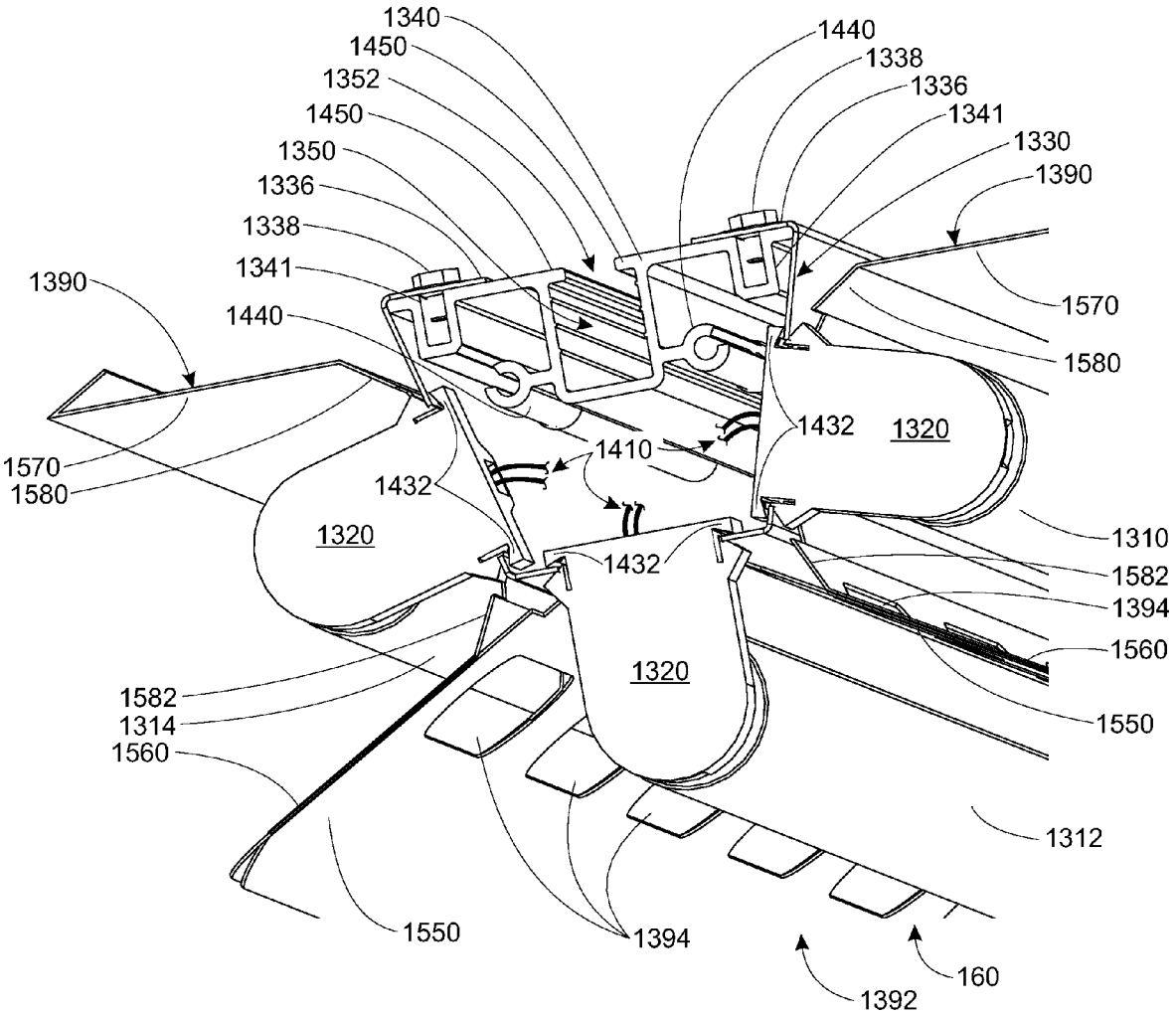
FIG. 14 is a fragmentary perspective view of an end of the reflector and lamp assembly with end cap removed to reveal a the cross section of the top frame member.
Figure 15:
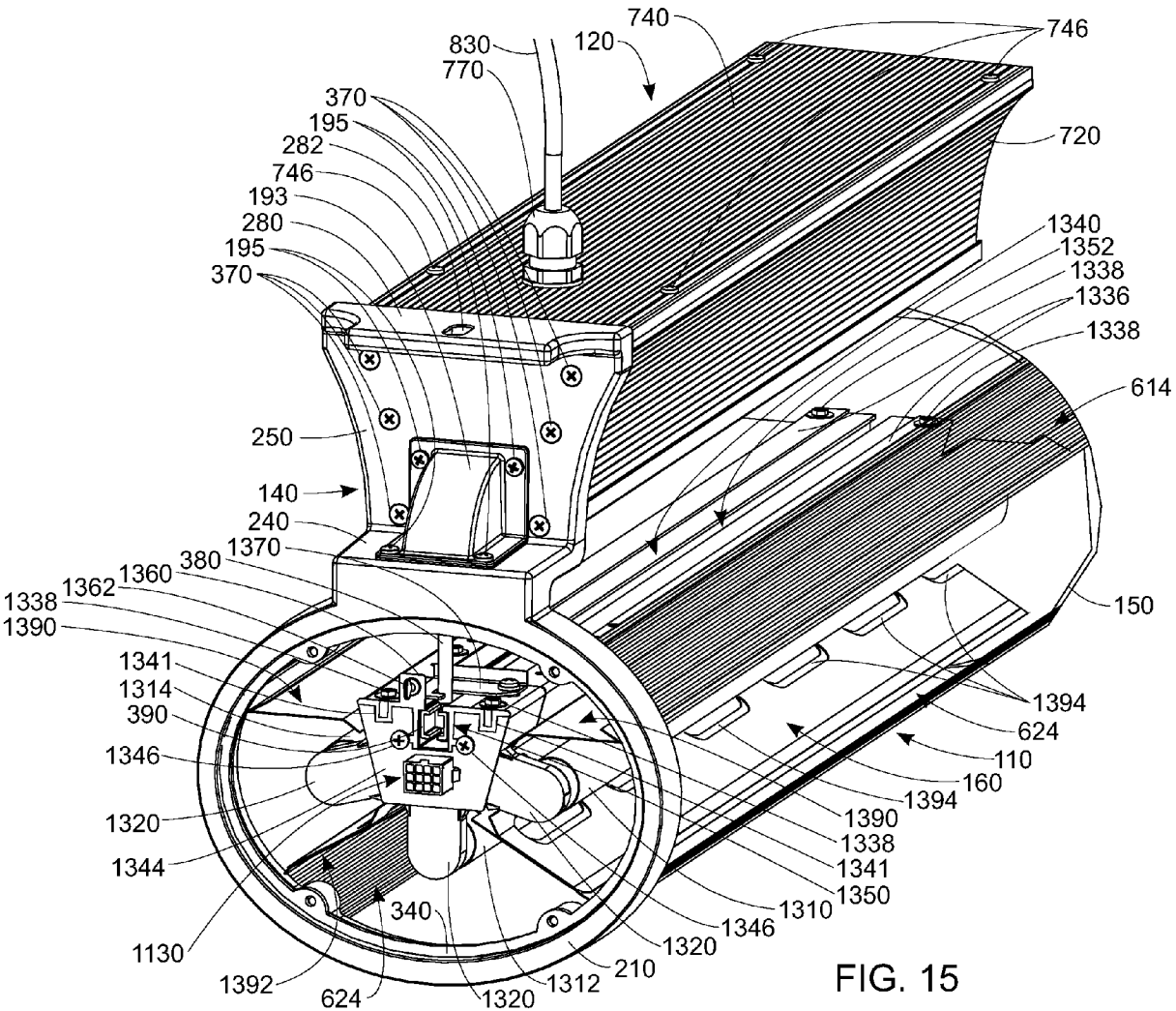
FIG. 15 is a fragmentary perspective view of an end of the luminaire of FIG. 1 with the end cap removed to reveal the end connector and locking mechanism of the reflector and lamp assembly.

Reference is now made to the perspective view in FIG. 13 showing the overall reflector and lamp assembly 160 in a three-fluorescent-lamp configuration according to an embodiment. Reference is also made to FIGS. 14 and 15, which show an end of the assembly 160 with an end cover plate removed and a partial perspective view of the end of the luminaire showing the assembly's locking mechanism engaged. The reflector and lamp assembly 160 of this embodiment comprises three fluorescent lamps 1310, 1312, 1314 arranged with the bottom lamp 1312 directly along the vertical centerline, and each side lamp 1310, 1314 symmetrically placed on an opposing side in a slightly, downwardly angled orientation. As described further below, this is only one possible orientation. The lamps are electrically connected to the ballast (355) via the connecting harness 1110 and mating multi-pin connectors 1120, 1130 using conventional bi-pin lamp holders 1320. The lamp holders 1320 are located on each opposing side of each, respective, lamp. Each pair of connectors physically supports the lamp at opposing ends. The connectors have leads 1410 that are routed to respective pins in the assembly's multi-pin connector 1130. These pins are removably attached to associated pins in the harness connector 1102, which is operatively connected with the ballast and electronics in the upper housing 120. Thus as also described above, no loose wires or splicings are required between the reflector and lamp assembly 160 and electronics.

It should be clear that, while a conventional, tubular fluorescent lamp is employed in this embodiment, the assembly can be used to mount other types of lamps that are adapted to install in the depicted bi-pin lamp form factor. For example LED-based tubular lamps can be employed in this embodiment, as well as compact fluorescents, etc. As described below, alternate for factors can be accommodated by entirely different lamp assemblies that are exchangeably mountable within the lower housing 110.

The reflector and lamp assembly 160 is centered around a main core housing 1330, which can be formed from sheet aluminum or sheet steel via a stamping or extrusion. Another material can be employed in alternate embodiments. In an embodiment, the housing is approximately 1.8 inches high on the vertical and tapers between a width (on the horizontal) between 2.5 inches at the top and 1.5 inches at the bottom—the downward taper thereby providing a downward slant to the side lamps 1310 and 1314. This slant is between approximately 12 and 18 degrees from the vertical in an embodiment, but this value is highly variable in alternate embodiments. These dimensions and angles can be altered in various embodiments, in part, to change the optimetrics of the luminaire as desired. In an embodiment, the ends of the core housing 1330 are notched to receive bases 1432 of the bi-pin lamp holders 1320. The top side of the core housing 1330 is defined by inwardly directed shoulders 1336 that provide a gap along the length of the core housing 1330. This gap is filled by an extruded aluminum top frame 1340 that spans the top side of the core housing 1330, and is secured to the core housing's shoulders by self-threading screws 1338 that each engage an extruded screw receiver 1341 on their respective side of the housing 1330. The top frame 1340 is constructed from 6063 aluminum alloy in an illustrative embodiment. Its walls have an approximate thickness of between 0.06 and 0.09 inch in an illustrative embodiment. However other materials and dimensions are expressly contemplated in alternate embodiments. The combination of the extruded top frame 1340 and core housing 1330 provides a sturdy and rigid, but relatively lightweight beam that is constructed with a minimum of parts and materials.

Each end of the core housing 1330 and top frame 1340 is capped by an end cap 1344 that can be constructed from steel plate (or plate of another material). At least one end cap 1344 carries the harness connector 1130 as depicted. Each end cap 1344 is secured using at least two self-threading screws 1346, that engage a respective receiver 1440 formed in the top frame 1340 as part of the extrusion. Each end cap 1344 includes a cutout that provides clearance from a C-shaped channel 1350. The channel is sized the surround the rail 390 with minimal play. The top of the channel 1350 contains an open slot 1352, which is narrower than the internal width of the slot due to a pair of inwardly-directed top shoulders 1450. The slot 1352 is sized to provide clearance for the posts 380 as the assembly 160 is slid onto and off of the rail 390. The size and shape of the internal cross-section of the channel 1350 and slot 1352 is adapted to the external cross section of the rail 390. In alternate embodiments, the internal cross-section of the channel can be varied to accommodate a rail with a different external cross section shape. By forming the channel 1350 in the extruded top frame, a high degree of precision in fit between the rail and channel can be achieved, reducing motion between these components due to vibration, etc. It should be clear that in alternate embodiments, the slidable engagement between the lower housing 110 and reflector/lamp assembly 160 can be achieved by a variety of other interengaging arrangements. For example, the depicted rail can be omitted, and the assembly can be mounted directly on posts with appropriately shaped ends. Likewise, a plurality of parallel rails can be provided in the housing 110 to engage side by-side channels in the assembly.

At least one end cap 1344 on the reflector and lamp assembly 160 includes an L-shaped tab that carries a thumbscrew 1362. This thumbscrew 1362 removably engages a hinged gate 1370, having a pivot formed by a screw on one side of the top frame 1340. The gate selectively crosses the slot 1352 and acts as a stop against the post 380. When the thumbscrew 1362 is loosened, the gate 1370 can be pivoted out of an interfering position with the front post 380, and the assembly 160 can be slid fully onto or off of the rail 390. A rear stop 1380 (FIG. 13) is also provided. In an embodiment, the rear stop 1380 is placed further inboard, as shown, to prevent inadvertent, complete pull-out of the assembly 160 by engaging the front post (the post normally locked by the gate 1370) after the assembly has been slid out of the housing 110 to a predetermined position. The stop 1380 includes a vertical leg 1383 and horizontal leg 1385. The horizontal 1385 leg is secured to the top frame 1340 by screws 1338. There is a notch 1382 that extends along the horizontal leg 1385 to an open rear mouth. Complete removal (pull-out) entails removing the end cap 172 adjacent to the stop 1380, and directing the lamp assembly 160 rearwardly so that the rear post rides within the notch 1382. In this position, the stop can be unfastened by removing one or more of its screws 1338. In most instances, where the lamp assembly 160 is being serviced (e.g. replacing lamps), there is no need to completely remove it from the housing, and the rear stop 1388 provides a desirable safety mechanism to prevent unwanted, complete pull-out and dropping of the assembly 160 during service. For example, where lamps are replaced, complete pullout of the assembly 160 may be unnecessary, and the assembly need only be exposed sufficiently to remove the old lamps from the holders and install the new lamps. However, where full removal of the lamp assembly is desired, such as in a retrofit operation, then removing the stop 1380 is desirable. The stop 1380 is positioned along the assembly 160 so that there is sufficient rail-to-channel engagement to prevent the assembly from breaking off the rail due to weight-induced torque. In an embodiment, three to five inches of mating length between the rail and the channel should be sufficient to avoid breakage.

In alternate embodiments, the stop can include a latch mechanism according to a conventional or custom design (for example a bullet catch) that allows it to be released from the opening of the lower housing 110 after the end cap 170 has been removed. The avoids the potential need to remove the rear end cap 172 to (first) remove the stop 1380 before fully withdrawing the lamp assembly 160. Note that in instances where both end caps 170 and 172 are removed, the lamp assembly 160 can also be removed from the rear end once the stop 1380 has been moved to a non-blocking position and/or removed from the assembly.

The reflector and lamp assembly 160 of this embodiment includes reflectors that run the elongated length of the assembly and surround each lamp 1310, 1312, 1314, extending approximately out to the inner wall of the lens 150. The above-described fluted surfaces (614, 624 in FIG. 6) in the lens 150 can be located to specifically account for the positioning to the outer edges of the reflectors. In an embodiment, the reflectors comprise a pair of opposing side reflector assemblies 1390 that surround the side lamps 1310 and 1314, and a bottom reflector assembly 1392. The bottom reflector assembly includes a pair of opposing panels 1550 (FIG. 15) that extend along opposing planes in a somewhat V-shape from the core housing 1330. The side reflector's (1390) bottom panels 1560 are generally flush with the opposing (non-exposed) surfaces of the panels 1550. Likewise the top panels 1570 of the side reflector assemblies 1390 extend substantially horizontally, assisting in avoiding spread of excess light onto the ceiling. The region of these side reflector assemblies, adjacent to the core housing 1330 and respective lamps 1310, 1314 define intermediate-angled transition segments 1580 and 1582 between a flat reflector surface that engages the core housing beneath each lamp and the respective, outwardly extended bottom and top panels 1560 and 1570. The overall side reflector cross section ensures that an efficient spread of light is achieved. The spread of light can be further enhanced by providing a series of optional slots 1394 through the panels 1550 and 1560 that allow migration of some light from the sides to the bottom so as to enhance the amount of light projected through the luminaire bottom. The size, shape and elongated spacing of the slots 1394 are highly variable. In an embodiment, the slots are ½-1 inch wide and 1-2 inches long.

In an alternate embodiment, the bottom reflector can be formed using the opposing sides of the side reflector's bottom panels. In this manner, a separate bottom reflector unit is not required.

The surface finish of each reflector assemblies' exposed surfaces is highly variable. In an embodiment, the surfaces have a highly specular surface finish achieved by anodizing, polishing, plating and/or another acceptable technique. The reflector substrate can be aluminum or another acceptable material.

II. Single Housing Vapor-Tight Luminaire

Figure 16:
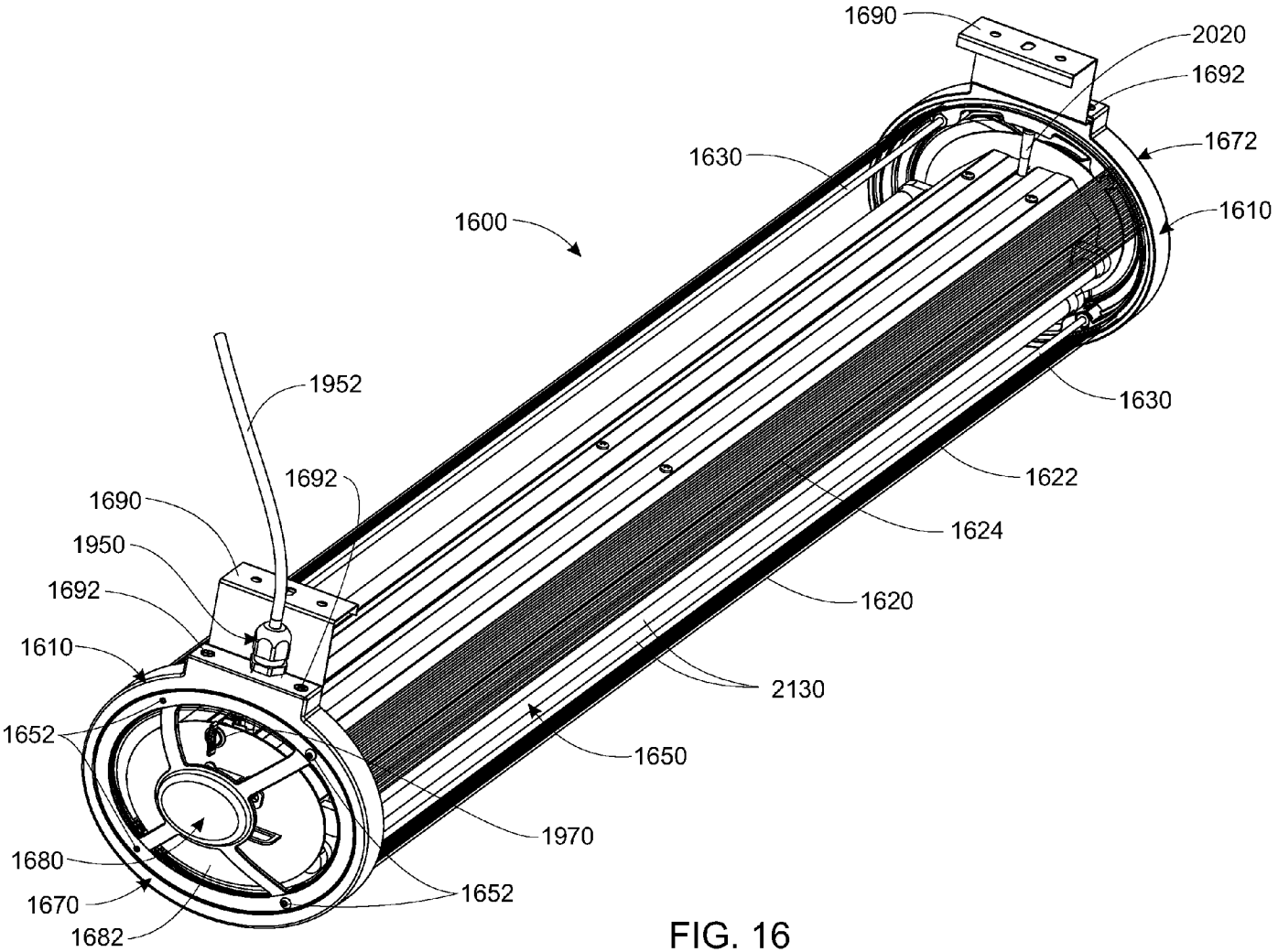
FIG. 16 is a perspective view of a single-housing vapor-tight luminaire according to an illustrative embodiment employing a plurality of fluorescent lamps in a removable reflector and lamp assembly.
Figure 17:
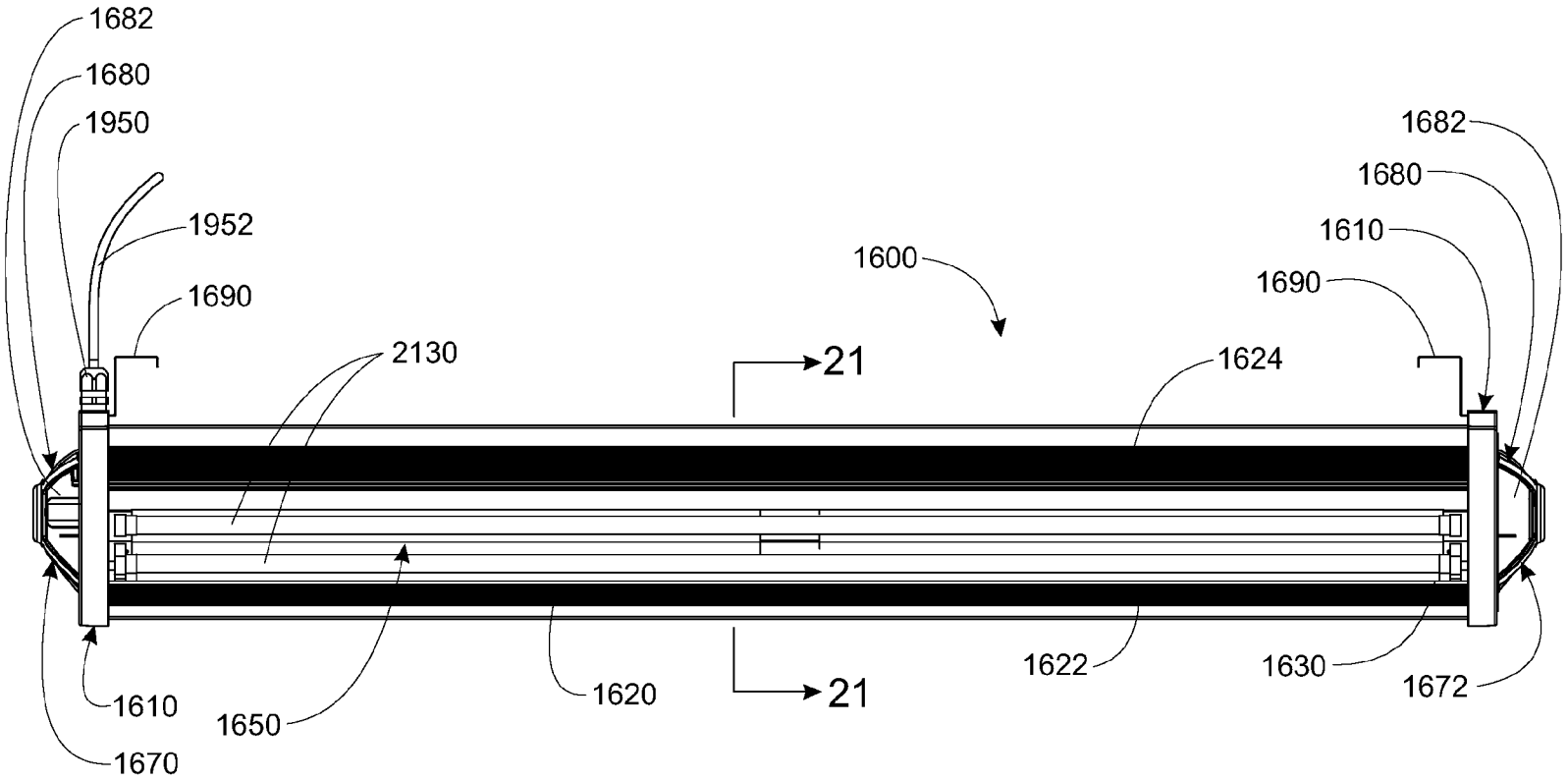
FIG. 17 is side view of the luminaire of FIG. 16.
Figure 18:
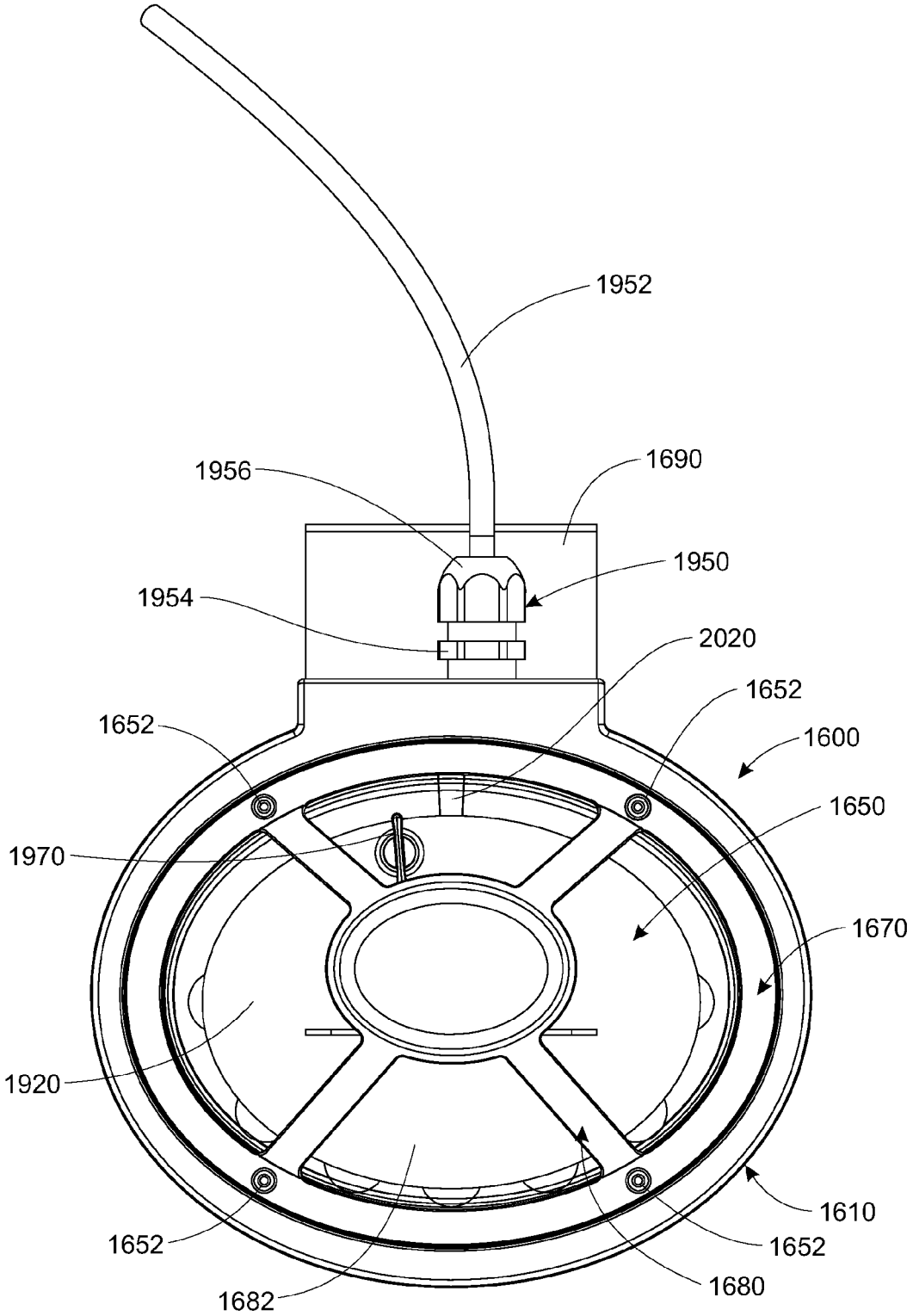
FIG. 18 is a frontal view of the luminaire of FIG. 16.

Reference is now made to FIGS. 16-18, which show the external view of a single-housing, vapor-tight luminaire 1600 according to an illustrative embodiment. Unless otherwise indicated, the relative dimensions, materials and functions with respect to the illustrative luminaire 1600 are similar to, or equivalent to those described above with respect to the main/lower housing 110 of the two-housing luminaire 100. In this embodiment, an upper housing is omitted and the opposing housing ends 1610 are adapted to support only a single tubular, translucent lens 1620, which can be same in material, dimensions and surface detail/finish to the lens 150. In alternate embodiments, the lens can vary in size and shape and/or can contain differing surface structures (e.g. frosting, prismatic facets, etc.) in locations on the lens that suit the optimetrics of the lamp assembly contained therein. In the illustrative embodiment, the lens 1620 includes the four, above-described fluted segments 1622 and 1624 that extend along the axial (elongated) length of the lens 1620 and around a portion of the overall lens perimeter. These fluted segments are optional, and can be omitted and/or repositioned in alternate embodiments, and/or the segments can be varied to define differing optical effects, as described above.

The lens 1620 is supported by each of the housing ends 1610 using a gasket (described above) positioned between each confronting edge and a corresponding ovular groove on the inside face of each housing/lens end 1610. The ends 1610 are maintained in compression against each of opposing ends of the lens 1620 using four relatively rigid metal (e.g. steel) rods 1630 that are positioned at four positions about the circumference of the luminaire 1600. The rods 1630 extend substantially parallel to the longitudinal axis of the luminaire 1600 and all reside within the enclosure of the lens, within approximately an inch of the lens' inner surface. In this manner the rods are relatively low in profile and offer minimal interference with the luminaire's internal components, such as the reflector and lamp assembly 1650. The rods 1630 can be approximately 3⁄16 to 3⁄8 inch in diameter in various embodiments and are threaded at each of opposing ends to receive end nuts 2110 (See FIG. 21 for clearest view) that allow the compression of the ends 1610 with respect to the lens 1620 to be set to a predetermined level that ensures a vapor-tight seal therebetween that also avoids buckling by the lens due to over-compression. In an embodiment, the nuts can comprise a recessed Allen-head or star-head nut that sits within a well in the end 1610. To remove one or both of the ends, the nuts 2110 are untightened from the rod ends. The rod ends are seated in internally-directed bases 2120 (FIG. 21) located about the inner perimeter of each end 1610. This rod arrangement provides desired structural integrity and compression to the overall assembly in a manner similar to the upper housing 120 in the previous embodiment.

The bases 2120 of the ends 1610 each include a through-hole into which each rod end passes (to engage a respective nut 2110 with a well) and a tapped hole 2122. Each tapped hole 2122 is adapted to receive a screw 1652 that removably secures a sealing end cap assembly 1670 and 1672 on each of opposing sides of the luminaire 1600. These end cap assemblies are similar or identical in form and function to those end cap assemblies 170 and 172 described above. In particular they each comprise an outer bezel 1680 (similar or identical to bezel 180 above) covering transparent, translucent or opaque dome 1682 (similar or identical to dome 420 above). The bezel and dome are compressibly secured against a gasket (shown and described above) that resides within each opposing end 1610 using the screws 1652. The screws 1652 can be substituted with an alternate fastening system that provides a sufficient vapor-tight seal to each end. Likewise, the size, shape and material that composes each of the bezel and the dome (or another shape, such as a plate-like cover) are all highly variable.

Figure 19:
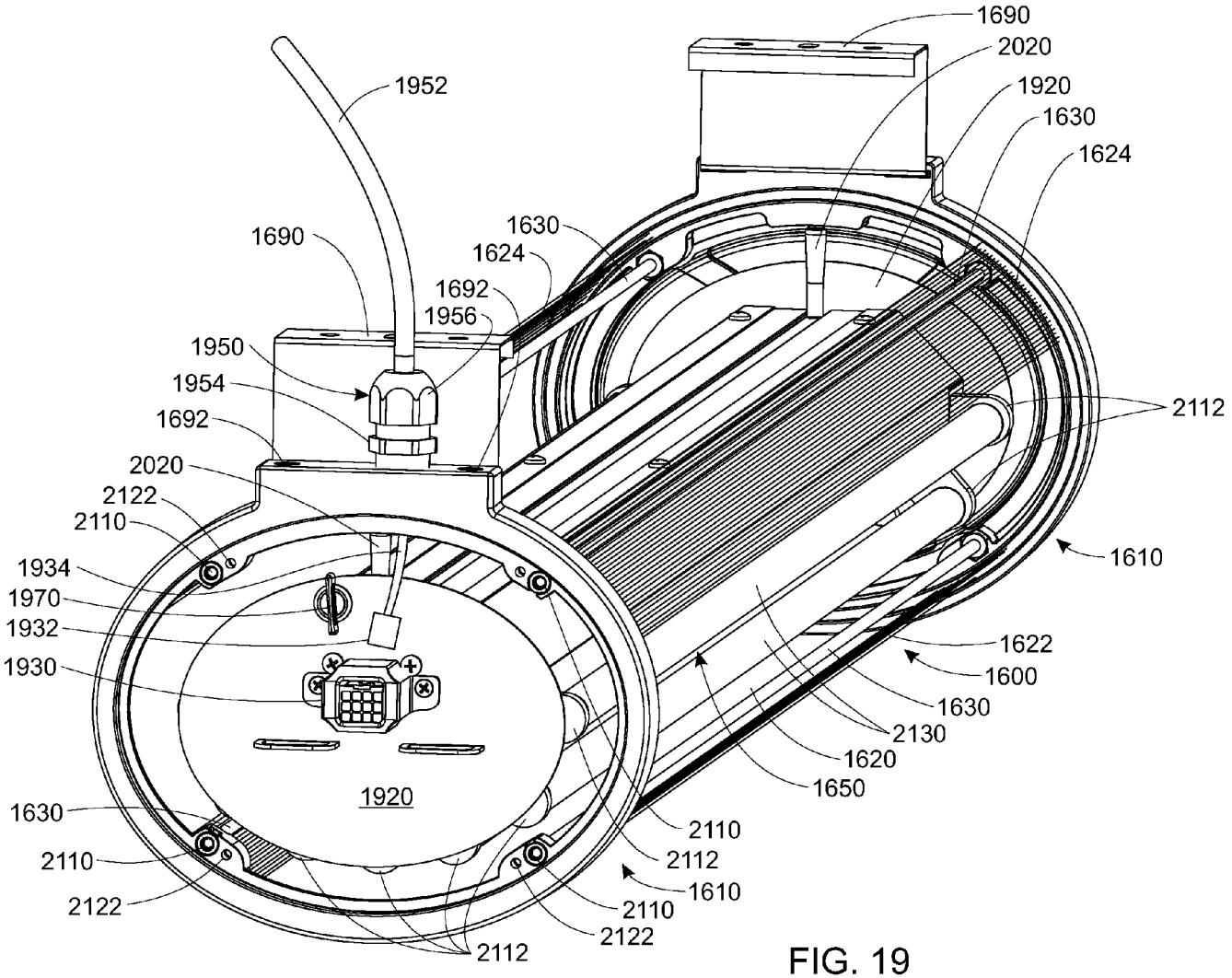
FIG. 19 is a perspective of the luminaire of FIG. 16 with an end cap assembly removed too expose the reflector and lamp assembly according to an embodiment.
Figure 20:
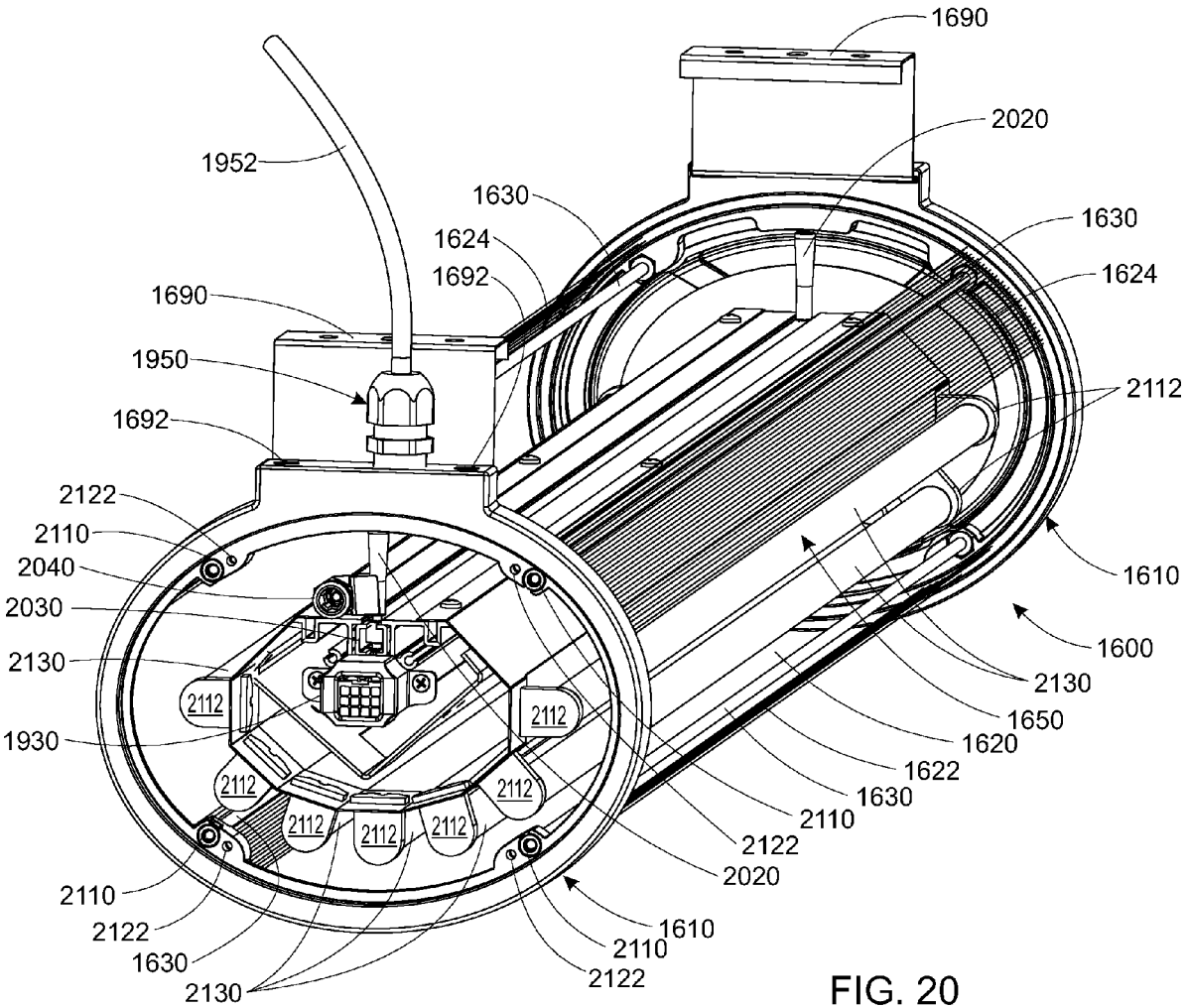
FIG. 20 is a perspective view of the luminaire as shown in FIG. 19 with the reflector and lamp assembly cover plate and locking assembly removed.
Figure 21:
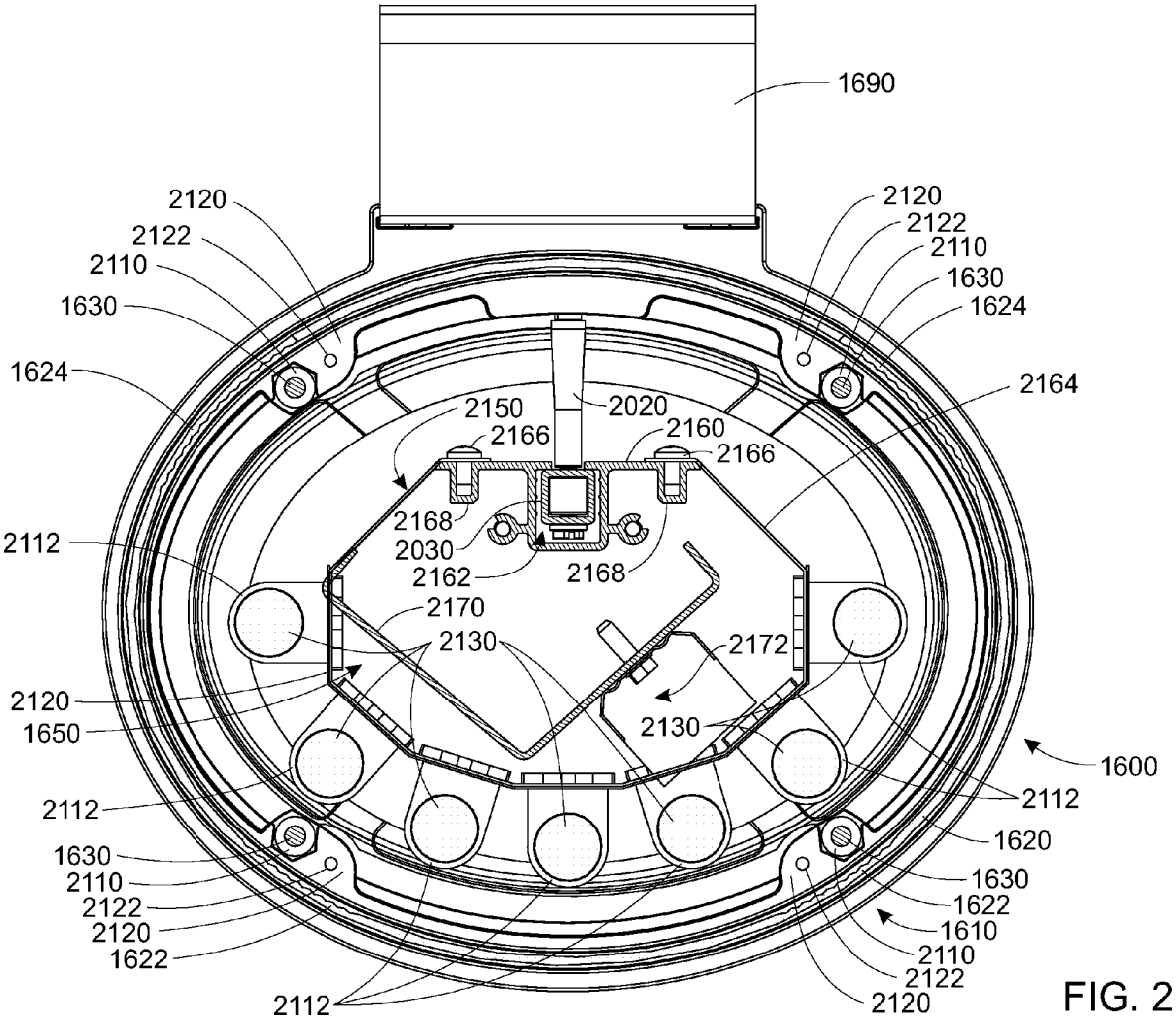
FIG. 21 is a front cross section of the luminaire taken along line 21-21 of FIG. 17 showing the internal structure of the reflector and lamp assembly according to an embodiment.

As described above, the interior of the luminaire 1600 is accessed by removing one or both of the end cap assemblies 1670, 1672. As shown in FIGS. 19-21, the end cap assembly 1670 has been removed to expose the interior, which includes a reflector and lamp assembly 1650 according to an illustrative embodiment. The reflector and lamp assembly 1650 in this embodiment includes seven (7) fluorescent lamps 2130 (see FIG. 21) that are placed at even arcuate intervals about an approximate semicircle about the longitudinal axis of the assembly 165. In this exemplary lamp arrangement, the lamps are a conventional T5 type. Other types can be used in various embodiments. This illustrative arrangement of lamps is supported by lamp connecting ends 2112 on an elongated, sheet metal a base member 2120 that can include a specular (or other) reflecting surface. This arrangement is generally free of external reflectors, but such can be provided in alternate embodiments. This arrangement of lamps affords full illumination coverage of the bottom, sides and a portion of the top of the housing/lens 1620). This reflector and lamp assembly is exemplary of a virtually limitless number of arrangements using florescent lamps or other alternate lamp types as described generally herein, which can be removably mounted in the housing of the luminaire 1600. Advantageously, the reflector and lamp assembly 1650 can be readily accessed and removed/swapped with another assembly as described above and further below.

As shown in FIG. 19, removing the end cap assembly 1670 exposes an end plate 1920 on the reflector and lamp assembly 1650. Each end of the assembly 1650 includes an appropriate end plate 1920. The depicted end plate carries a multi-pin (e.g. Molex) electrical connector 1930 that removably interconnects to a connector 1932 on the end of a harness cable 1934 passing into the housing via a channel in the housing end 1610. The channel for guiding the harness into the housing is described further below with reference to FIG. 23. In general, the exterior of the end 1610 includes a threaded connector 1950 (similar to connector 770 described above) that seals the connection against moisture infiltration. The connector illustratively includes a conventional male-threaded base member 1954 that is secured into the cast end 1610, and a removable, female-threaded cap member. From this connector 1950 extends a harness cable 1952 (that can include power and other wiring, such as communications, video, etc.) that is tied to a power source such as a 277 VAC lighting circuit. The multi-pin connector 1932 is operatively interconnected with the lamp circuit (including, for example, a ballast assembly—described further below) and other electrical components within the interior of the housing.

Figure 22:
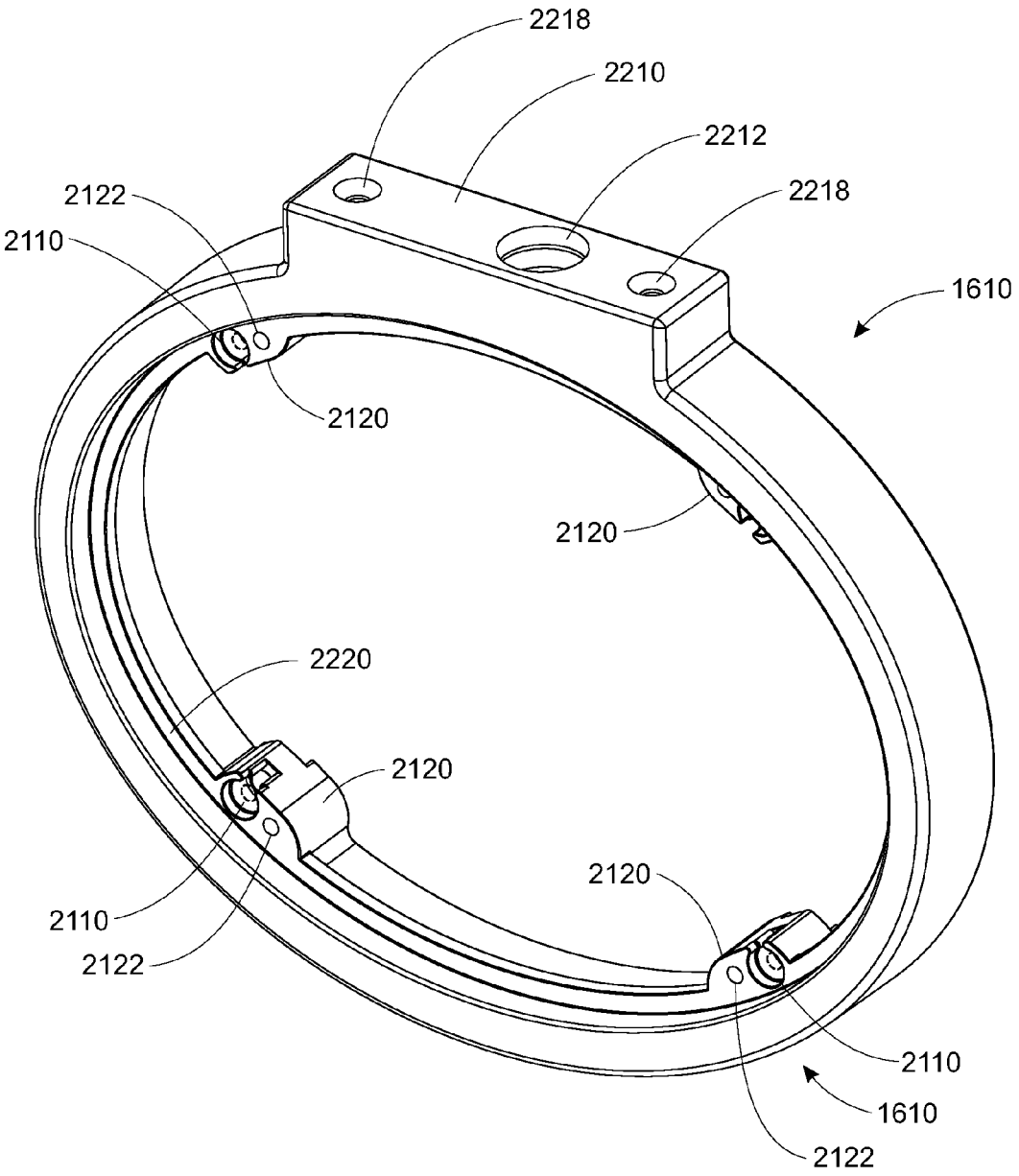
FIG. 22 is a outside perspective view of a housing end structure for supporting the lens/housing cover.
Figure 22A:
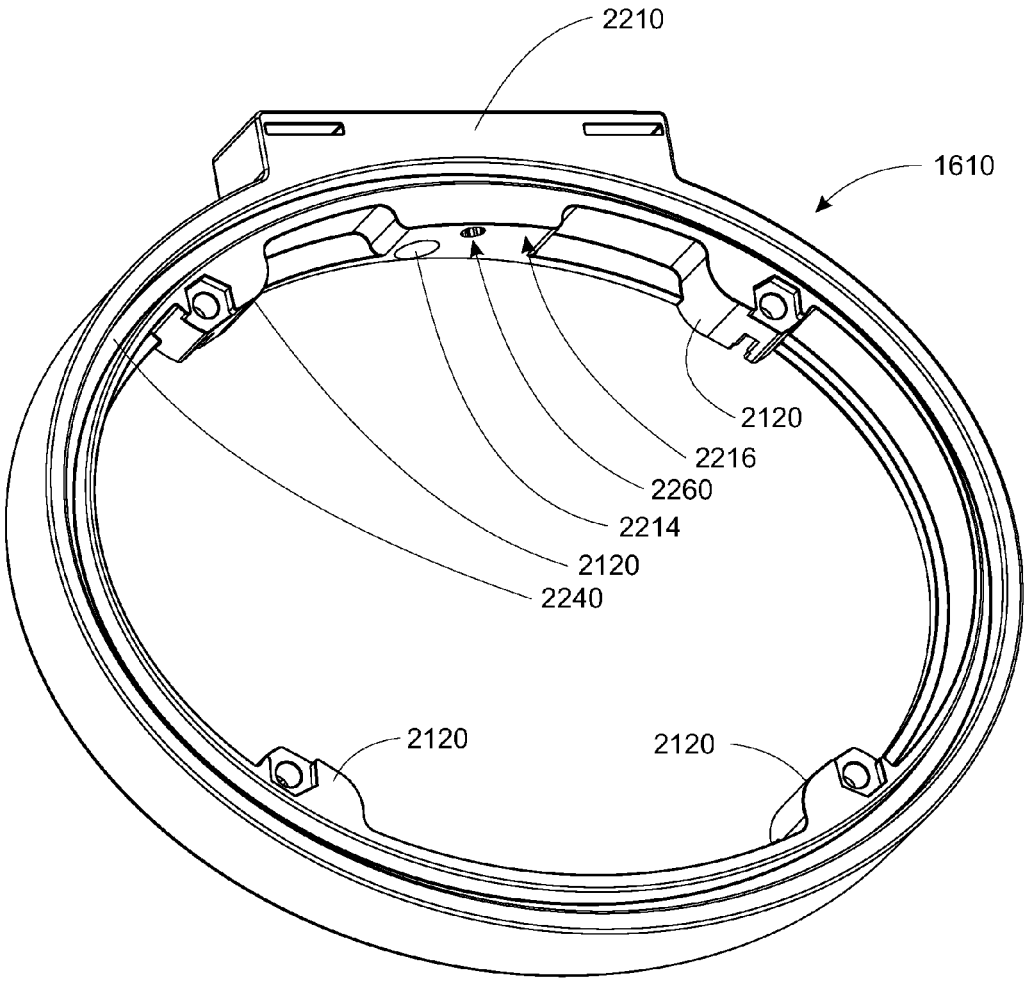
FIG. 22A is an inside perspective view of a housing end structure for supporting the lens/housing cover.

One housing end 1610 of the luminaire 1600 is shown in further detail in FIGS. 22 and 22A. The end 1610 includes a raised, flat top 2210 with a threaded hole 2212 (FIG. 22) that receives the harness connector base member 1954 (FIG. 19). The hole includes a through-bore 2214 that exits the inner perimeter 2216 (FIG. 22A) of the housing end 1610. The through bore is between approximately ¼ and ½ inch in diameter so as to accommodate a harness of an appropriate dimension. This arrangement enables a harness cable to pass into the housing from an external environment in a manner that is free of any penetration of the lens, and in a manner that maintains a good long-term, vapor-tight seal using conventional sealed cable connectors. The raised, flat top 2210 also includes a pair of threaded holes (not through-holes) that receive screws 1692 for securing a mounting bracket 1690 (FIG. 16). In this embodiment, the bracket is a flattened S-shape that is adapted to secure to a ceiling-mounted post or flush bolt assembly located adjacent to each opposing end of the luminaire, and as described generally above (FIGS. 8 and 9). The brackets can be formed from stamped sheet steel of an appropriate gauge.

Figure 22B:
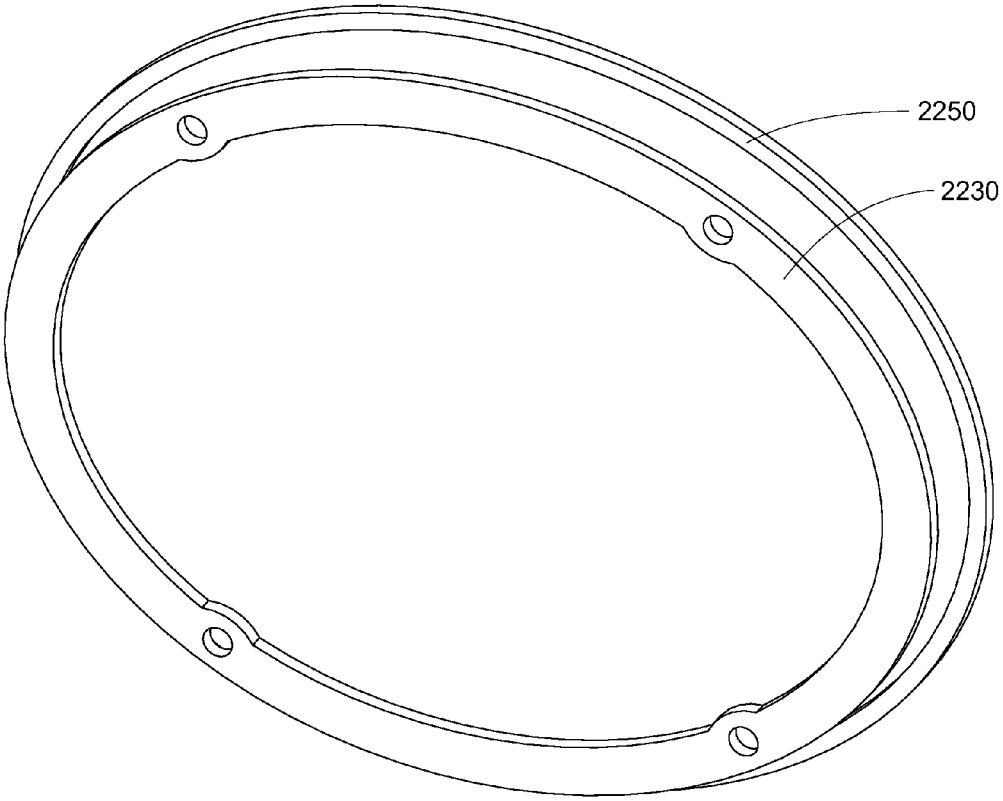
FIG. 22B is a perspective view of the outer and inner gaskets applied to the opposing sides of the housing end of FIGS. 22 and 22A.

Referring again to FIG. 22 the outside face of the housing end 1610 includes a recessed ledge 2220 that receives a conforming gasket 2230 as shown in FIG. 22B. This gasket 2230 includes four holes 2232 that are aligned with screw holes 2122. The gasket 2230 can be constructed from any acceptable sealing material, such as Poron (as described above) and sealably compresses when the end cap assembly 1670 or 1672 is fastened to the housing end by screws 1652. With reference to FIG. 22A, the inside face of the housing end 1610 also defines a ledge 2240 that conforms to the outer perimeter of the lens/housing 1620. A conforming gasket 2250 (FIG. 22B) seats within this ledge and sealingly compresses when the rod ends (1630) are tightened to a predetermined distance. This gasket 2250 can also be constructed from any acceptable sealing material, such as Poron. In an embodiment, the thickness of each gasket 2230, 2250 is similar or identical to that of the above-described gaskets 340 and 322, respectively.

As shown in FIG. 22A, the top inner perimeter of each housing end includes a threaded hole 2260 that receives the threaded end of a support post 2020 (similar to post 380 described above) The post 2020 supports an end of a square channel member "rail" 2030 (similar to rail 390 described above). This rail slidably supports the reflector and lamp assembly 1650. The reflector and lamp assembly 1650 is removably locked within the housing a winged screw 1970 (FIG. 19) that, when tightened, compresses the end plate 1920 against a female threaded base 2040 (FIG. 20) that is secured with respect to the post 2020. Removing the screw 1970 allows the end plate 1920 to be separated from the base 2040, and the reflector and lamp assembly can thus be slid out of the lens/housing assembly through one of the open housing ends 1610. In practice, both end cap assemblies 1970, 1972 are removed during disassembly and the rear end 1920 plate adjacent to end cap 1972 (or both end plates 1920) is removed to allow slidable clearance with respect to the posts 2020. The end plates operate in part to shield the ends from light transmission (although they can be light-transmitting in whole or in part. The end plates also provide an additional safety mechanism against inadvertent slippage of the reflector and lamp assembly from the housing. Note that additional safety mechanisms, such as an appropriate version of the rear stop 1380 (described above), can be provided to the reflector and lamp assembly 1650 of this embodiment.

Figure 23:
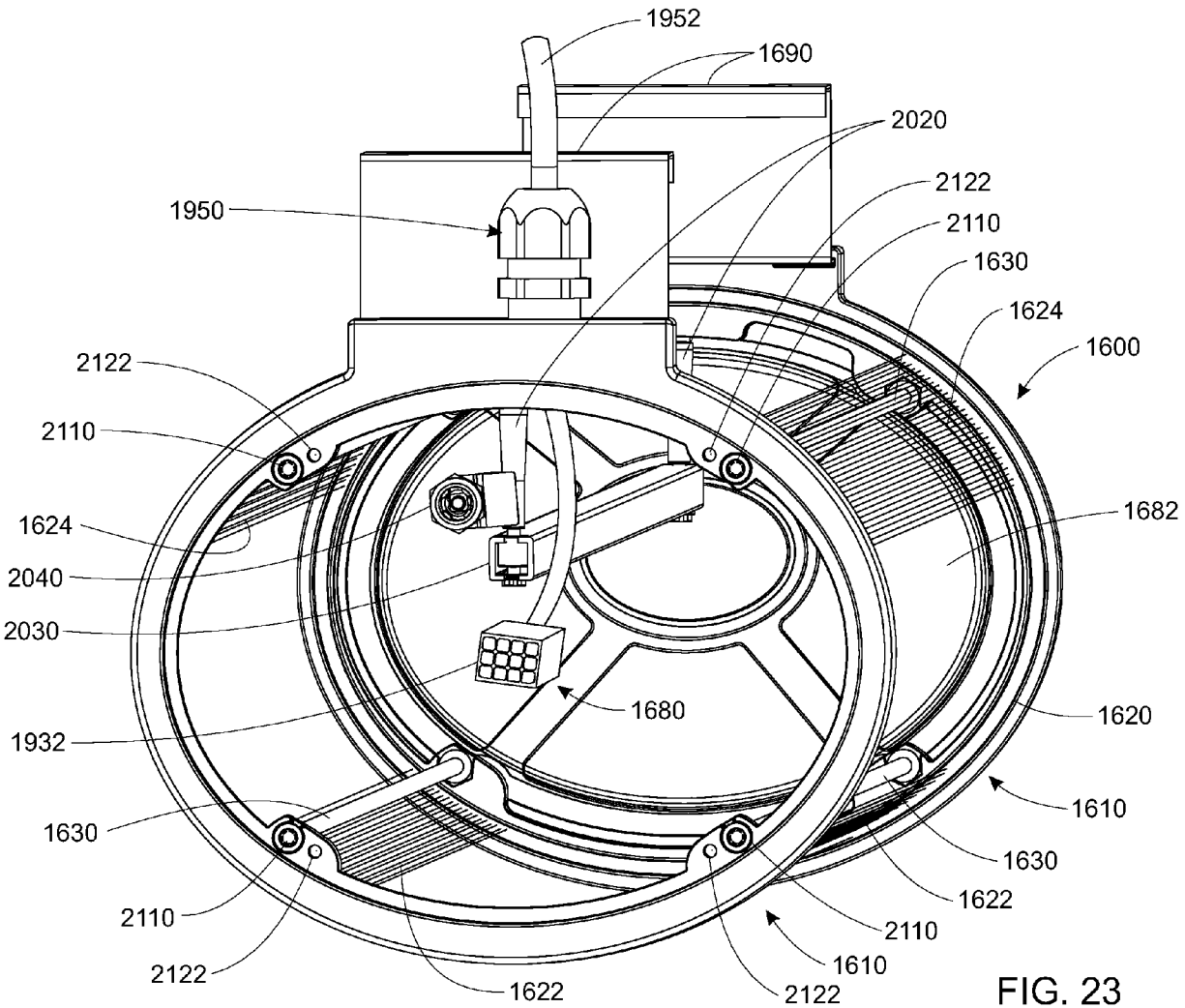
FIG. 23 is a perspective view of the luminaire of FIG. 16 showing the housing with the reflector and lamp assembly removed.

FIG. 23 shows the housing with end cap 1970 removed and the reflector and lamp assembly also removed, revealing the open housing with the rail 2030 exposed. Note that the multi-pin connector is removed from the corresponding connector (1930) on the reflector and lamp end plate. As in other embodiments described herein, the illustrative luminaire 1600 is generally free of twisted wire connections between the external power source and the overall reflector and lamp assembly making for quick and easy removal of the assembly and equally and quick reconnection of a the existing assembly or a new assembly within the housing. A new replacement assembly can have the same or a different lamp and optimetric profile. In general any driving electronics for the lamps is contained on the assembly itself. Also, in servicing an existing unit, the user need not manipulate the bulbs, wiring or the electronics of the reflector and lamp assembly while it is installed within the housing and/or suspended from the ceiling. Rather, the user can unplug the connector 1932 and slidably remove the entire reflector and lamp assembly, and then service any components on a bench or other convenient surface. This improves the efficiency of the service process and avoids a potentially hazardous situation in which service personnel must stand suspended on a ladder or lift while performing potentially delicate wiring tasks.

Figure 24:
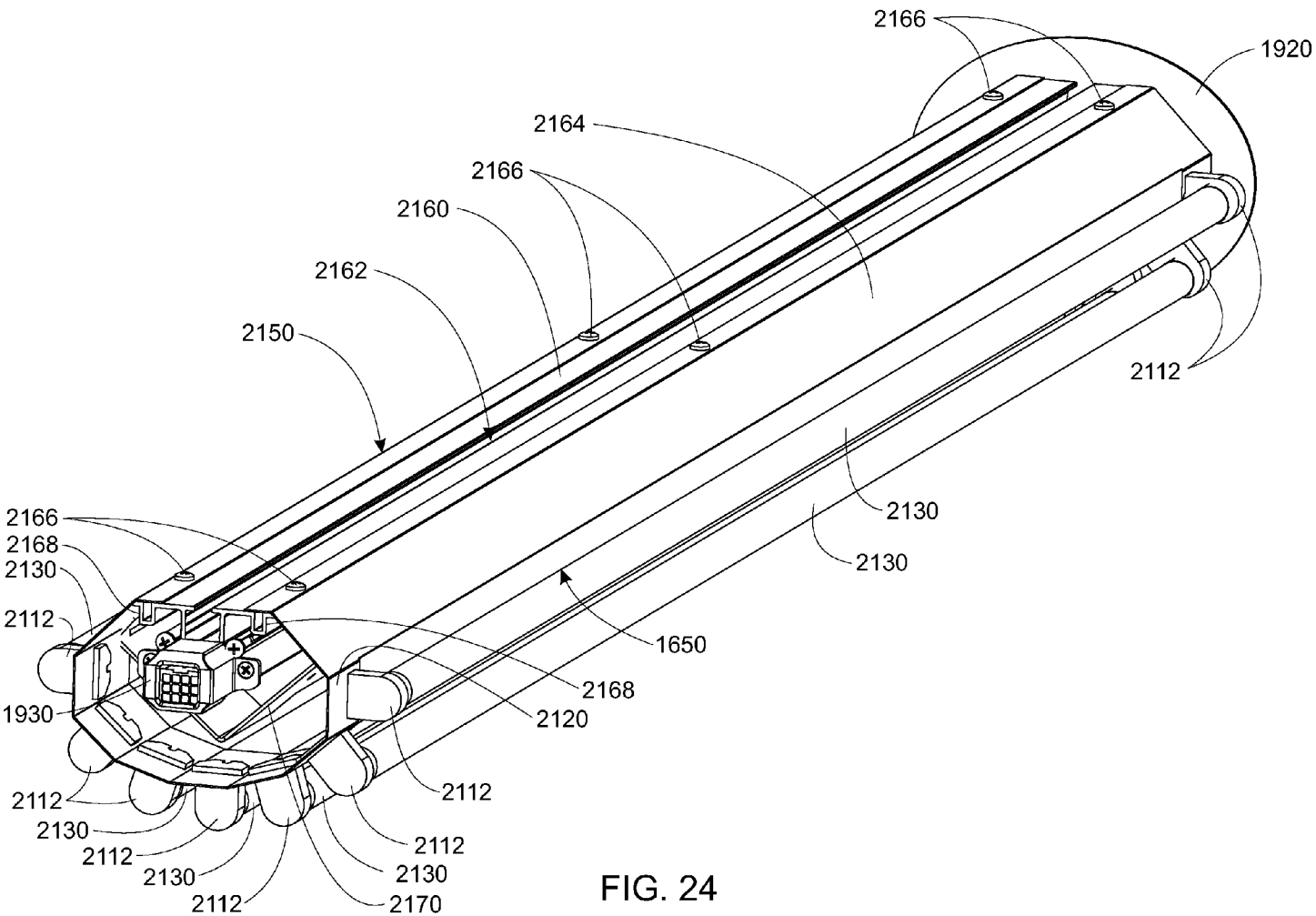
FIG. 24 is a perspective view of the removable reflector and lamp assembly according to an embodiment.

Reference is now made particularly to the luminaire cross section of FIG. 21 and the depiction of the removed, exemplary reflector and lamp assembly 1650 of FIG. 24. As described above, this assembly is exemplary of a wide range of lamp arrangements, lamp types, reflector arrangements and/or optimetrics. The reflector consists of a core housing 2150 that includes an extruded aluminum top frame 2160 similar in form and function to the top frame 1340 described above. In particular, the top frame 2160 includes a slotted channel 2162 that accommodates the rail 2030 of the housing and allows clearance for the posts 2020 as described above. It includes appropriate slots and channels for top and end-mounted fasteners as described generally above for top frame 1340. The core housing 2150 includes a stamped metal (sheet aluminum, steel, etc.) shell 2164 that is secured to the top frame 2160 by top-mounted fasteners 2166. The fasteners 2166 are secured into each of a pair of screw slots 2168 that are part of the extrusion, and described above. The interior of the core housing 2150 includes a bracket member 2170 that can support luminaire electronics, such as a conventional fluorescent ballast 2172. Other electronic components can be housed within the core housing 2150 using appropriate bracket arrangements. Wiring (not shown) can be provided between components as appropriate. Wiring and components can be accessed by, for example disassembling the core housing for service, replacement, upgrade and the like once the reflector and lamp assembly 1650 is removed from the lens/housing.

The material and volume of the lens/housing 1620 are sufficient to dissipate heat generated by the lamps and the electronics to the outside environment under substantially all conditions of temperature and humidity. The top portion of the lens/housing can optionally include an opaque and/or reflective surface or a plate that blocks the passage of light to the ceiling to avoid unwanted lighting effects as described above. In an illustrative embodiment, the opaque section can be a co-extrusion with the transparent/translucent lower portion of the lens. Also, in various embodiments, the depicted lens can include, along its interior surface an overlay removably located against an interior surface. This overlay comprises a thin (typically polymer) sheet material that resides around at least a portion of a perimeter of the lens and extends along the longitudinal direction/axis. This overlay defines a surface that alters the transmission of light through the lens (e.g. a diffusive surface). In various embodiments, the top can also include other structures such as an external heat sink that overlies the tubular lens/housing, where additional heat dissipation is desirable. Other options, such as external camera and/or sensor pods, wireless communication devices and the like can be applied to both the interior and/or the exterior of the luminaire—for example on the housing ends.

It should be clear that the luminaire 1600 of the illustrative embodiment, as well as other embodiments contemplated herein provides a highly aesthetic, reliable and easy-to-service unit. This luminaire is readily upgradable and allows for safe and efficient service of existing reflector and lamp assemblies following removal from the housing. The housing can be reliably resealed after access, and maintains vapor-tight performance over an extended period due to smaller perimeter sealing surface that are not prone to warpage. Notably, the modular nature of the illustrative embodiments allows for a given installed housing to keep up with changes in lighting technology by swapping out only the reflector and lamp assembly and associated electronics.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, at least a portion of the electronics used to drive the lamp and other devices associated with the luminaire can be mounted within the main housing and remain in position therein when the reflector and lamp assembly are removed. Likewise, the location of some or all of the electronic components is highly variable and additional electronics housings can be provided inside or outside of the main housing. Moreover the cross sectional shape and size of the tubular lens, as well as its length are highly variable. In addition, while each illustrative luminaire herein is shown as a single, discrete unit, it is expressly contemplated that housing ends can be adapted to couple a plurality of luminaire's in a line to create an overall luminaire of a predetermined, extended length. Likewise, the length of the luminaire can be varied to afford the user a range of possible sizes. The rods extending between the housing ends (along the longitudinal direction) can have a variety of surface finishes (e.g. specular) and placements (e.g. with respect to the fluted surfaces on the tubular lens) to alter their appearance and/or cause them to blend into the luminaire's overall appearance. More generally, optimetrics can be varied using lamp placement, shields and/or reflectors to generate certain desired lighting effects—for example the end of the unit can be modified to appropriately project light with respect to an adjacent wall surface. Accordingly, this description is meant to be taken only by way of example, and not to otherwise limit the scope of this invention.

What is claimed is:

1. A vapor-tight luminaire comprising:

a vapor-tight housing defining a continuous and unbroken sealed tubular lens extending in a longitudinal direction, the housing having a pair of end cap structures removably and sealably mounted on each of opposing respective housing ends, the housing removably supporting a lamp assembly; and a supporting rail suspended from each of the opposing housing ends that slidably supports the lamp assembly, wherein each of the housing and the lamp assembly are constructed and arranged to allow the lamp assembly to be passed into and out of the housing along the supporting rail when at least one of the end cap structures is removed from the respective one of the housing ends.

2. The vapor-tight luminaire as set forth in claim 1 further comprising a plurality of rods that extend between each of the housing ends in the longitudinal direction and that provide compression between each of the housing ends and an adjacent edge of the tubular lens.

3. The vapor-tight luminaire as set forth in claim 2 wherein at least one of the end cap structures defines an interior volume that extends outward from the respective one of the housing ends.

4. The vapor-tight luminaire as set forth in claim 3 wherein the lamp assembly includes a first part of an electrical connector assembly and the interconnecting harness includes a second, mating, part of the electrical connector assembly, the electrical connector assembly residing in the volume of one of the end cap structures.

5. The vapor-tight luminaire as set forth in claim 4 wherein at least one of the end cap structures defines a light-transmitting dome.

6. The vapor-tight luminaire as set forth in claim 5 further comprising a bezel that mounts over at least one of the end cap structures, at least one of the end cap structures being secured to the respective one of the housing ends by a plurality of fasteners that compress a gasket against the respective one of the housing ends.

7. The vapor-tight luminaire as set forth in claim 6 further comprising a gasket between the housing end and the respective end of the tubular lens.

8. The vapor-tight luminaire as set forth in claim 2 further comprising a wiring harness cable that enters one of the housing ends through a sealing connector.

9. The vapor-tight luminaire as set forth in claim 8 wherein the harness cable includes a first end connector that removably interconnects with a second end connector on the lamp assembly, the second end connector being operatively connected to each of electronics and lamps within the lamp assembly.

10. The vapor-tight luminaire as set forth in claim 9 wherein the electronics include a ballast mounted on the lamp assembly and the lamps include a plurality of tubular fluorescent lamps.

11. The vapor-tight luminaire as set forth in claim 1 wherein the tubular lens comprises a light-transmitting polymer.

12. The vapor-tight luminaire as set forth in claim 1 wherein the tubular lens defines an ovular cross section along a plane perpendicular to the longitudinal direction.

13. The vapor-tight luminaire as set forth in claim 1 wherein the lens includes a plurality of fluting formations extending in a direction of the longitudinal direction at predetermined locations about a perimeter of the lens.

14. The vapor-tight luminaire as set forth in claim 1 wherein the lamp assembly includes a locking mechanism that selectively secures the lamp assembly against sliding along the rail.

15. The vapor-tight luminaire as set forth in claim 14 wherein the locking mechanism includes a screw that engages an end plate on the lamp assembly.

16. The vapor-tight luminaire as set forth in claim 1 wherein the tubular lens includes an opaque top section formed as a co-extrusion.

17. The vapor-tight luminaire as set forth in claim 1 wherein at least a portion of the lamp assembly is constructed as a metal extrusion including channels for receiving threaded fasteners thereinto.

18. The vapor-tight luminaire as set forth in claim 1 further comprising an overlay removably located against an interior surface of the lens around at least a portion of a perimeter thereof, the overlay defining a surface that alters the transmission of light through the lens.

19. A method for replacing or retrofitting a lamp assembly in a luminaire comprising the steps of:

providing (a) a vapor-tight lower housing defining a continuous and unbroken sealed tubular lens having a pair of end cap structures and a lamp assembly contained therein, and (b) an interconnecting harness between the housing and the lamp assembly;

removing an end cap respectively from at least one of the end cap structures to define an end opening in the lower housing;

disconnecting the lamp assembly from the interconnecting harness;

sliding the lamp assembly through the end opening and out of the lower housing;

sliding a replacement lamp assembly through the end opening and into a final position therein;

connecting the interconnecting harness to the replacement lamp assembly; and attaching the end cap to the one of the end cap structures to form a vapor-tight seal at the lower housing.

* * * * *